US009253573B2

(12) United States Patent
Nakano

(10) Patent No.: US 9,253,573 B2
(45) Date of Patent: Feb. 2, 2016

(54) ACOUSTIC SIGNAL PROCESSING APPARATUS, ACOUSTIC SIGNAL PROCESSING METHOD, PROGRAM, AND RECORDING MEDIUM

(71) Applicant: Sony Corporation, Tokyo (JP)

(72) Inventor: Kenji Nakano, Kanagawa (JP)

(73) Assignee: Sony Corporation, Tokyo (JP)

( * ) Notice: Subject to any disclaimer, the term of this patent is extended or adjusted under 35 U.S.C. 154(b) by 112 days.

(21) Appl. No.: 14/351,184

(22) PCT Filed: Nov. 14, 2012

(86) PCT No.: PCT/JP2012/079464

§ 371 (c)(1),
(2) Date: Apr. 11, 2014

(87) PCT Pub. No.: WO2013/077226

PCT Pub. Date: May 30, 2013

(65) Prior Publication Data

US 2014/0286511 A1 Sep. 25, 2014

(30) Foreign Application Priority Data

Nov. 24, 2011 (JP) ..... 2011-256142

(51) Int. Cl.
*H04R 5/02* (2006.01)
*H04S 3/00* (2006.01)
*H04S 7/00* (2006.01)

(52) U.S. Cl.
CPC *H04R 5/02* (2013.01); *H04S 3/002* (2013.01); *H04S 7/307* (2013.01); *H04S 2400/01* (2013.01); *H04S 2420/01* (2013.01)

(58) Field of Classification Search
CPC . H04S 2420/01; H04S 2400/01; H04S 3/002; H04S 1/002; H04S 2400/15
USPC ..... 381/300
See application file for complete search history.

(56) References Cited

U.S. PATENT DOCUMENTS 6,442,277 B1 * 8/2002 Lueck ..... H04S 5/00 381/1
2008/0063224 A1 * 3/2008 De Klerk ..... H04R 1/227 381/304
2011/0286614 A1 * 11/2011 Hess ..... H04S 7/303 381/302

FOREIGN PATENT DOCUMENTS

| | | |
|---|---|---|
| JP | 2008-211834 | 9/2008 |
| JP | 2009-260574 | 11/2009 |
| JP | 2010-258497 | 11/2010 |
| JP | 2011-151633 | 8/2011 |
| JP | 2011-160179 | 8/2011 |

OTHER PUBLICATIONS

飯田他、空間音響学、日本、コロナ社、Spatial Hearing, Jul. 2010, p. 19-21.

* cited by examiner

*Primary Examiner* — Mark Blouin
(74) *Attorney, Agent, or Firm* — Paratus Law Group, PLLC

(57) ABSTRACT

The present technology relates to an acoustic signal processing apparatus, an acoustic signal processing method, a program, and a recording medium for improving a localization of sound of a sound image at a position deviated from the front center plane of a listener to the left side of the right side. A binauralization processing unit generates a first binaural signal by superimposing an HRTF on an opposite side of a sound source on an acoustic signal and a second binaural signal by attenuating components of a band in which a first notch and a second notch of the HRTF on the opposite side of the sound source appear among components of a signal obtained by superimposing an HRTF on a side of the sound source on the acoustic signal. A crosstalk compensation processing unit performs, with respect to the first binaural signal and the second binaural signal, a crosstalk compensation for canceling out an acoustic transfer characteristic and a crosstalk. The present technology can be applied to, for example, an AV amplifier.

12 Claims, 14 Drawing Sheets

ACOUSTIC SIGNAL PROCESSING APPARATUS, ACOUSTIC SIGNAL PROCESSING METHOD, PROGRAM, AND RECORDING MEDIUM

CROSS REFERENCE TO PRIOR APPLICATION

This application is a National Stage Patent Application of PCT International Patent Application No. PCT/JP2012/079464 (filed on Nov. 14, 2012) under 35 U.S.C. §371, which claims priority to Japanese Patent Application No. 2011-256142 (filed on Nov. 24, 2011), which are all hereby incorporated by reference in their entirety.

TECHNICAL FIELD

The present technology relates to an acoustic signal processing apparatus, an acoustic signal processing method, a program, and a recording medium, and more particularly, to an acoustic signal processing apparatus, an acoustic signal processing method, a program, and a recording method for achieving a virtual surround.

BACKGROUND ART

In recent years, in the area of stereophonics, there is a tendency to express an acoustic field in an up-down direction by adding a speaker on the upper side as well as on a lateral side and a rear side.

On the other hand, not many families install as many speakers as the number of channels in a home theater, and hence a product of virtual surround system (front surround system) that artificially creates a surround acoustic field only with a front speaker is getting mass popularity.

Therefore, it is assumed that few families install a speaker on the upper side as the lateral side and the rear side, and hence a method of artificially creating the speaker on the upper side only with the front speaker is needed in the same manner as the conventional front surround system.

It has been known that peaks and dips appearing on a high frequency side in amplitude-frequency characteristic of a head-related transfer function (HRTF) is a telling clue for a localization of sound of a sound image in the up-down direction and the front-back direction (see, for example, Patent Document 1). It is assumed that these peaks and dips are formed mainly by reflection, diffraction, and resonance due to a shape of an ear.

Further, as shown in FIG. 1, it is indicated that a positive peak P1 appearing near 4 kHz and two notches N1 and N2 appearing first in a frequency band equal to or higher than the frequency band where the peak P1 appears among these peaks and dips have particularly high contribution to the localization of sound in the up-down and front-back directions (see, for example, Non-Patent Document 1).

In this specification, the dip indicates a portion that is recessed in the downward direction compared to a surrounding portion on a waveform diagram such as the amplitude-frequency characteristic of the HRTF. The notch indicates, among the dips, a dip particularly having a narrow width (for example, a bandwidth in the amplitude-frequency characteristic of the HRTF) and a depth equal to or deeper than a predetermined depth, i.e., a sharp negative peak appearing on the waveform diagram.

It is not recognized that the peak P1 depends on a direction of a sound source, and hence the peak P1 appears in the virtually same band regardless of the direction of the sound source. In Non-Patent Document 1, it is considered that the peak P1 is a reference signal used for a human sensory system to search for the notches N1 and N2, and a physical parameter that substantially contributes to the localization of sound in the up-down and front-back directions includes the notches N1 and N2.

Hereinafter, the notches N1 and N2 of the HRTF are referred to as a first notch and a second notch, respectively.

CITATION LIST

Patent Document

Patent Document 1: JP 2008-211834 A

Non-Patent Document

Non-Patent Document 1: Iida, et al., "Spatial Acoustics", Japan, Corona Publishing Co., Ltd., July 2010, pp 19-21.

SUMMARY OF THE INVENTION

Problems to be Solved by the Invention

However, the study on the localization of sound in the up-down and front-back directions in Non-Patent Document 1 described above is just a consideration within a range of a front center plane that is a plane obtained by cutting a head of a listener in the front-hack direction. For this reason, for example, when a sound image is localized at a position deviated from the front center plane to the left side or the right side, it is not clear whether the theory of Non-Patent Document 1 is effective or not.

To cope with this problem, the present technology is designed to improve the localization of sound of the sound image at a position deviated from the front center plane of a listener to the left side or the right side.

Solutions to Problems

An acoustic signal processing apparatus according to a first aspect of the present technology includes a first binauralization processing unit configured to generate a first binaural signal by superimposing a first head-related transfer function between a virtual sound source deviated from a front center plane at a predetermined listening position to a left side or a right side and a first ear on a far side from the virtual sound source at the listening position on an acoustic signal, a second binauralization processing unit configured to generate a second binaural signal by attenuating, among components of a signal obtained by superimposing a second head-related transfer function between the virtual sound source and a second ear on a near side to the virtual sound source at the listening position on the acoustic signal, components of a first band and a second band, where the first band and the second band are a lowest band and a second lowest band, respectively, among bands in which a negative peak having a depth equal to or deeper than a predetermined depth appears on an amplitude of the first head-related transfer function at a frequency equal to or higher than a predetermined frequency, and a crosstalk compensation processing unit configured to perform a crosstalk compensation processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

The first binauralization processing unit is configured to generate a third binaural signal by attenuating components of the first band and the second band among components of the first binaural signal, and the crosstalk compensation processing unit is configured to perform the crosstalk compensation processing with respect to the second binaural signal and the third binaural signal.

The predetermined frequency can be a frequency at which a positive peak appears in proximity of 4 kHz of the first head-related transfer function.

An acoustic signal processing method according to the first aspect of the present technology includes generating a first binaural signal by superimposing a first head-related transfer function between a virtual sound source deviated from a front center plane at a predetermined listening position to a left side or a right side and a first ear on a far side from the virtual sound source at the listening position on an acoustic signal, generating a second binaural signal by attenuating, among components of a signal obtained by superimposing a second head-related transfer function between the virtual sound source and a second ear on a near side to the virtual sound source at the listening position on the acoustic signal, components of a first band and a second band, the first band and the second hand being a lowest band and a second lowest band, respectively, among bands in which a negative peak having a depth equal to or deeper than a predetermined depth appears on an amplitude of the first head-related transfer function at a frequency equal to or higher than a predetermined frequency, and performing a crosstalk compensation processing for, canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

A program according to the first aspect of the present technology or a program stored in a recording medium according to the first aspect of the present technology causes a computer to execute generating a first binaural signal by superimposing a first head-related transfer function between a virtual sound source deviated from a front center plane at a predetermined listening position to a left side or a right side and a first ear on a far side from the virtual sound source at the listening position on an acoustic signal, generating a second binaural signal by attenuating, among components of a signal obtained by superimposing a second head-related transfer function between the virtual sound source and a second ear on a near side to the virtual sound source at the listening position on the acoustic signal, components of a first band and a second band, the first band and the second band being a lowest band and a second lowest band, respectively, among bands in which a negative peak having a depth equal to or deeper than a predetermined depth appears on an amplitude of the first head-related transfer function at a frequency equal to or higher than a predetermined frequency, and performing a crosstalk compensation processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

An acoustic signal processing apparatus according to a second aspect of the present technology includes an attenuation unit configured to generate a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency and a signal processing unit configured to perform, in an integrated manner, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

The predetermined frequency can be a frequency at which a positive peak appears in proximity of 4 kHz of the first head-related transfer function.

The attenuation unit can include an infinite impulse response (IIR) filter, and the signal processing unit can include a finite impulse response (FIR) filter.

An acoustic signal processing method according to the second aspect of the present technology includes generating a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency and performing, in an integrated manner, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

A program according to the second aspect of the present technology or a program stored in a recording medium according to the second aspect of the present technology causes a computer to execute generating a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency and performing, in an integrated manner, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

According to the first aspect of the present technology, a first binaural signal is generated by superimposing a first head-related transfer function between a virtual sound source deviated from a front center plane at a predetermined listening position to a left side or a right side and a first ear on a far side from the virtual sound source at the listening position on an acoustic signal, a second binaural signal is generated by attenuating, among components of a signal obtained by superimposing a second head-related transfer function between the virtual sound source and a second ear on a near side to the virtual sound source at the listening position on the acoustic signal, components of a first band and a second band, the first band and the second band being a lowest band and a second lowest band, respectively, among bands in which a negative peak having a depth equal to or deeper than a predetermined depth appears on an amplitude of the first head-related transfer function at a frequency equal to or higher than a predetermined frequency, and a crosstalk compensation processing is performed for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

According to the second aspect of the present technology, a second acoustic signal is generated by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear are performed in an integrated manner.

Effects of the Invention

According to the first aspect or the second aspect of the present technology, the localization of sound of the sound image at a position deviated from the front center plane of a listener to the left side or the right side can be improved.

MODE FOR CARRYING OUT THE INVENTION

Modes for carrying out the present technology (hereinafter, "embodiments") are described in detail below. The descriptions are given in the following order.

1. Theory Applied to the Present Technology
2. First Embodiment (example of providing a notch forming equalizer only on a side of a sound source)
3. Second Embodiment (example of providing a notch forming equalizer on a side of a sound source and an opposite side of the sound source)
4. Third Embodiment (example of integrating a transaural processing)
5. Modification Examples

1. THEORY APPLIED TO THE PRESENT TECHNOLOGY

Firstly, a theory applied to the present technology is described below with reference to FIGS. 2 to 6.

A method of playing a sound recorded with a microphone arranged around an ear through a headphone around the ear is known as a binaural recording/playing method. A two-channel signal recorded by the binaural recording is referred to as a binaural signal, which contains acoustic information on a position of a sound source in an up-down direction and in a front-back direction as well, as a lateral direction to a human.

Further, a method of playing this binaural signal by using the two-channel speakers on the left side and the right side, not the headphone, is referred to as a transaural playing method. However, if a sound based on the binaural signal is simply output from the speakers as it is, for example, a crosstalk is generated, such that a sound for the right ear is audible to the left ear of the listener. Further, for example, an acoustic transfer characteristic from the speaker to the right ear is superimposed while a waveform of the sound for the right ear arrives at the right ear of the listener, and hence the waveform is distorted.

Therefore, in the transaural playing method, a pre-processing for canceling out the crosstalk and the unnecessary acoustic transfer characteristic is performed on the binaural signal. Hereinafter, this pre-processing is referred to as a crosstalk compensation processing.

The binaural signal can be generated even without recording a sound by a microphone around an ear. Specifically, the binaural signal is a signal obtained by superimposing an HRTF from a position of a sound source to a position around the ear on an acoustic signal. Therefore, if the HRTF component is known, the binaural signal can be generated by performing a signal processing of superimposing the HRTF or the acoustic signal. Hereinafter, this processing is referred to as a binauralization processing.

In a front surround system based on the HRTF, the binauralization processing and the crosstalk compensation processing are performed.

Figure 1:
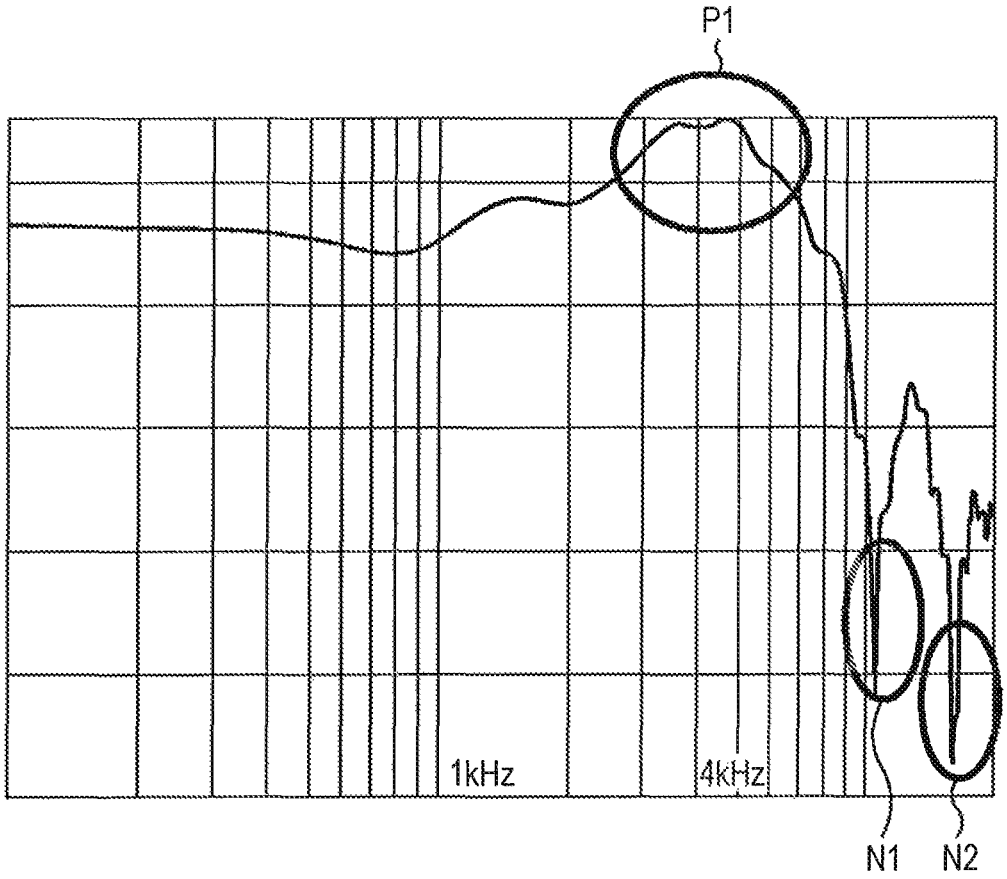
FIG. 1 is a graph showing an example of an HRTF.
Figure 2:
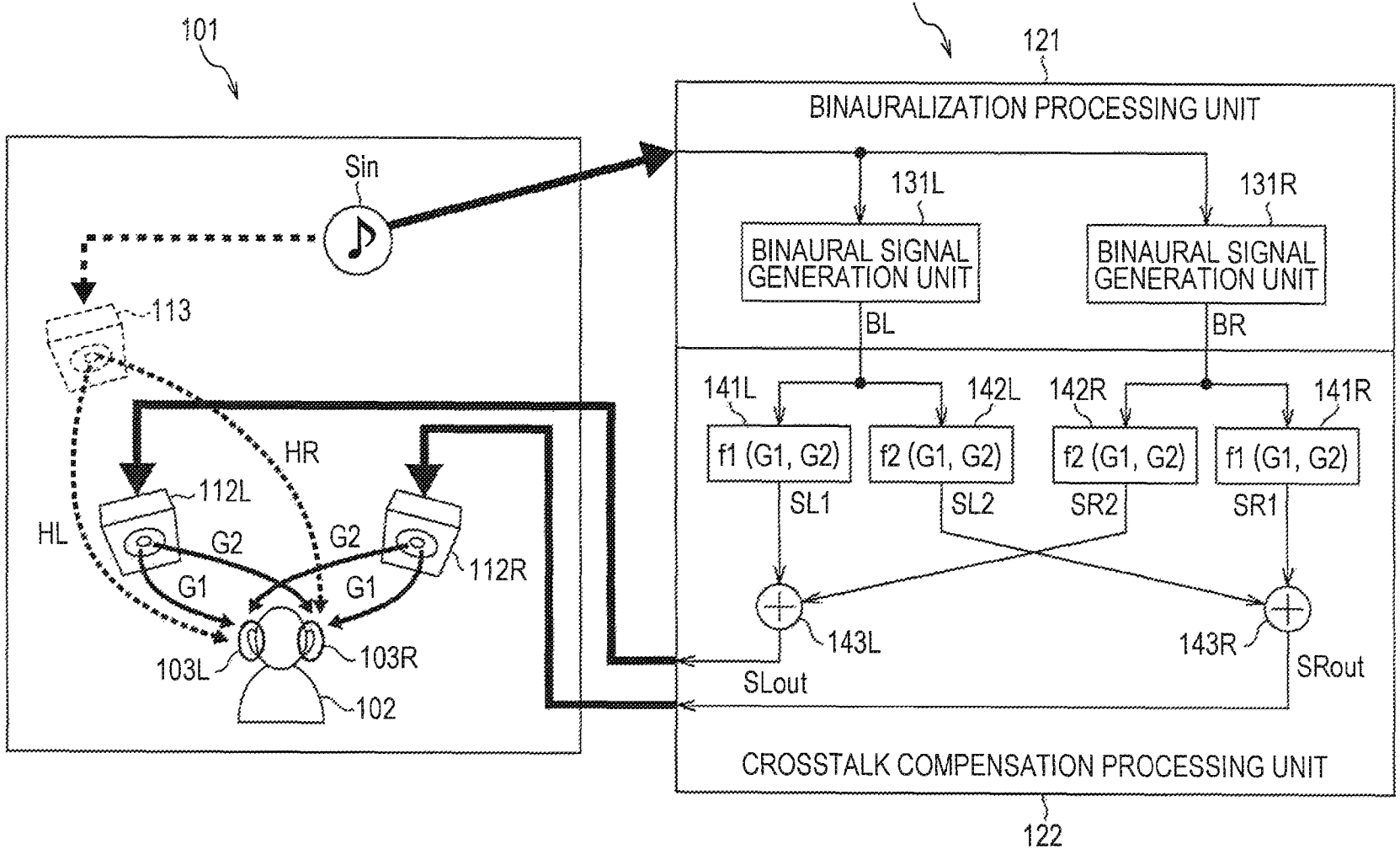
FIG. 2 is a schematic diagram showing an acoustic signal processing system according to an embodiment for achieving a front surround system based on the HRTF.

FIG. 2 is a block diagram showing an acoustic signal processing system 101 according to an embodiment, for achieving a front surround system based on the HRTF.

The acoustic signal processing system 101 includes an acoustic signal processing unit 111 and speakers 112L and 112R. The speakers 112L and 112R are arranged symmetrically ahead of a predetermined ideal listening position in the acoustic signal processing system 101.

The acoustic signal processing system 101 achieves a virtual speaker 113, which is a virtual sound source, by using the speakers 112L and 112R. That is, the acoustic signal processing system 101 can localize, with respect to a listener 102 at a predetermined listening position, an image of a sound output from the speakers 112L and 112R at a position of the virtual speaker 113.

Hereinafter, unless otherwise noted, as shown in FIG. 2, a case where the position of the virtual speaker 113 is set to a front left upwardly oblique position of the listening position (listener 102).

Further, hereinafter, among left and right directions with reference to the listening position, a side close to the virtual speaker 113 is referred to as a side of the sound source, and a side far from the virtual speaker 113 is referred to as an opposite side to the sound source or an opposite side of the sound source. Therefore, in the case shown in FIG. 2, the left side of the listening position is the side of the sound source, and the right, side is the opposite side of the sound source.

Moreover, hereinafter, an HRTF between the virtual speaker 113 and a left ear 103L of the listener 102 is referred to as a head-related transfer function HL, and an HRTF between the virtual speaker 113 and a right ear 103R of the listener 102 is referred to as a head-related transfer function HR. Further, hereinafter, between the above-mentioned two head-related transfer functions, the head-related transfer function corresponding to an ear of the listener 102 on the side of the sound source (side close to the virtual speaker 113) is referred to as an HRTF on the side of the sound source, and the head-related transfer function corresponding to an ear of the listener 102 on the opposite side of the sound source (side far from the virtual speaker 113) is referred to as an HRTF on the opposite side of the sound source. Moreover, hereinafter, the ear of the listener 102 on the opposite side of the sound source is also referred to as a shadow side ear.

Further, hereinafter, in order to simplify explanations, an HRTF between the speaker 112L and the left ear 103L of the listener 102 and an HRTF between the speaker 112R and the right ear 103R of the listener 102 are assumed to be the same, and this HRTF is referred to as a head-related transfer function G1. Moreover, hereinafter, in order to simplify explanations, an HRTF between the speaker 112L and the right ear 103R of the listener 102 and an HRTF between the speaker 112R and the left ear 103L of the listener 102 are assumed to be the same, and this HRTF is referred to as a head-related transfer function G2.

The acoustic signal processing unit 111 includes a binauralization processing unit 121 and a crosstalk compensation processing unit 122. The binauralization processing unit 121 includes binaural signal generation units 131L and 131R. The crosstalk compensation processing unit 122 includes signal processing units 141L and 141R, signal processing units 142L and 142R, and addition units 143L and 143R.

The binaural signal generation unit 131L generates a binaural signal BL by superimposing the head-related transfer function HL on an acoustic signal. Sin input from outside.

The binaural signal generation unit 131L supplies the generated binaural signal BL to the signal processing unit 141L and the signal processing unit 142L.

The binaural signal generation unit 131R generates a binaural signal BR by superimposing the head-related transfer function HR on the acoustic signal Sin input from the outside. The binaural signal generation unit 131R supplies the generated binaural signal BL to the signal processing unit 141R and the signal processing unit 142R.

The signal processing unit 141L generates an acoustic signal SL1 by superimposing a predetermined function f1(G1, G2) having the head-related transfer functions G1 and G2 as variables on the binaural signal BL. The signal processing unit 141L supplies the generated acoustic signal SL1 to the addition unit 143L.

Similarly, the signal processing unit 141R generates an acoustic signal SR1 by superimposing the function f1(G1, G2) on the binaural signal BR. The signal processing unit 141R supplies the generated acoustic signal SR1 to the addition unit 143R.

The function f1(G1, G2) is expressed as, for example, following Equation (1).

$$f1(G1,G2)=1/(G1+G2)+1/(G1-G2) \quad (1)$$

The signal processing unit 142L generates an acoustic signal SL2 by superimposing a predetermined function f2(G1, G2) having the head-related transfer functions G1 and G2 as variables on the binaural signal BL. The signal processing unit 142L supplies the generated acoustic signal SL2 to the addition unit 143R.

Similarly, the signal processing unit 142R generates an acoustic signal SR2 by superimposing the function f2(G1, G2) on the binaural signal BR. The signal processing unit 142R supplies the generated acoustic signal SR2 to the addition unit 143L.

The function f2(G1, G2) is expressed as, for example, following Equation (2).

$$f2(G1,G2)=1/(G1+G2)-1/(G1-G2) \quad (2)$$

The addition unit 143L generates an acoustic signal SLout by adding the acoustic signal SL1 and the acoustic signal SR2. The addition unit 143L supplies the acoustic signal SLout to the speaker 112L.

The addition unit 143R generates an acoustic signal SRout by adding the acoustic signal SR1 and the acoustic signal SL2. The addition unit 143R supplies the acoustic signal SRout to the speaker 112R.

The speaker 112L outputs a sound based on the acoustic signal SLout, and the speaker 112R outputs a sound based on the acoustic signal SRout.

With this configuration, theoretically, the virtual speaker 113 is supposed to be installed freely by adjusting the head-related transfer functions HL and HR applied to the binaural signal generation units 131L and 131R.

However, an experiment of applying actually measured head-related transfer functions HL, HR, G1, and G2 to the acoustic signal processing unit ill revealed that the listener 102 could hardly obtain a stable localization of sound. In particular, it was found that a sound image dulls in a high, frequency band or a sound image is localized at a position unbalanced to a side of a speaker used for playing, such that the sound image could hardly be localized at a position of the virtual speaker 113 in a stable manner.

An experiment was conducted to study how a first notch and a second notch of the HRTF on the side of the sound source and the opposite side of the sound source act when the position of the sound source is at a position deviated from the front center plane at the listening position to the left side or the right side.

Figure 3:
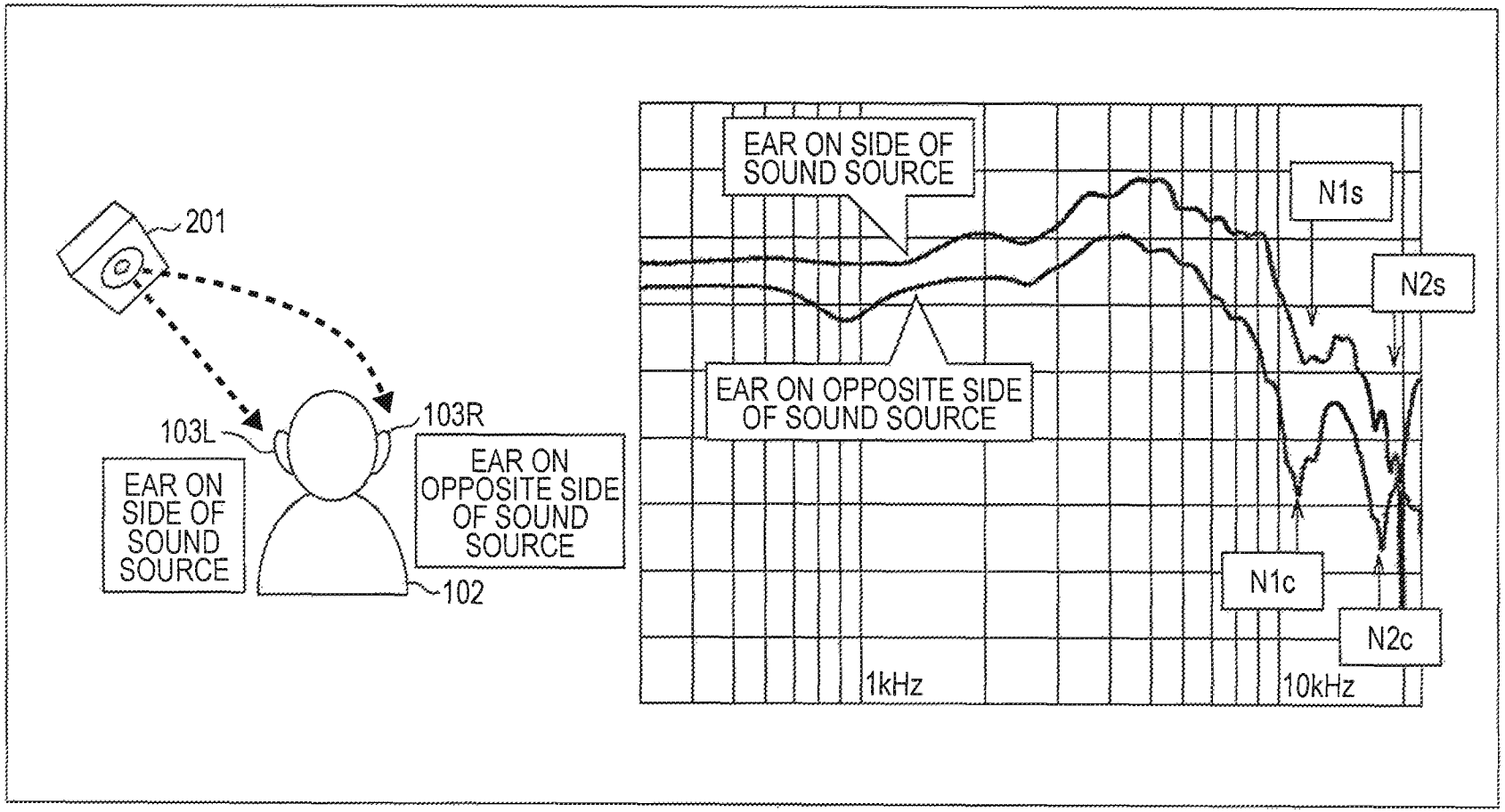
FIG. 3 is a graph showing an example of a measurement result of the HRTF for a sound source arranged on a front left upwardly oblique position of a listener.

Firstly, HRTFs for the left ear 103L and the right ear 103R of the listener 102 were measured when a sound is output from a speaker 201 installed at a front left upwardly oblique position of the listener 102 (a full-sized doll in an actual case). FIG. 3 shows a result of the measurement.

According to this measurement result, a first notch N1*s* and a second notch N2*s* appear on the HRTF of the side of the sound source for the left ear 103L on the side of the sound source. Further, a first notch N1*c* and a second notch N2*c* appear on the HRTF on the opposite side of the sound source for the right ear 103R on the opposite side of the sound source. In this manner, the first notch and the second notch appear on both the HRTF on the side of the sound source and the HRTF on the opposite side of the sound source.

An experiment was conducted to compare influences of the first notch and the second notch of the HRTF on the side of the sound source and the first notch and the second notch of the HRTF on the opposite side of the sound source on the auditory sense of the listener.

Figure 4:
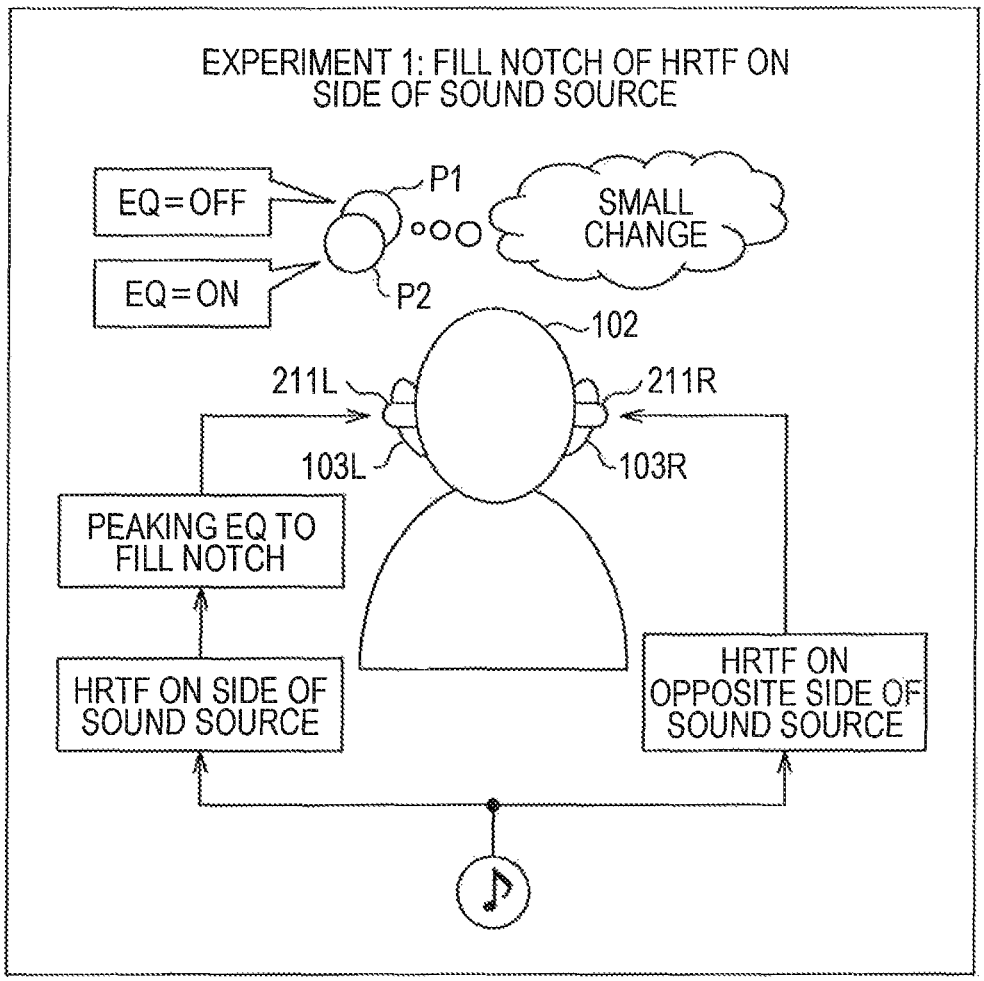
FIG. 4 is a schematic diagram for explaining an experiment for studying an influence of a notch of the HRTF on a side of the sound source on an auditory sense of a listener.

Firstly, an experiment was performed to study the influence of the first notch and the second notch of the HRTF on the side of the sound source on the auditory sense of the listener. Specifically, as shown in FIG. 4, the HRTF on the side of the sound source and the HRTF on the opposite side of the sound source for a sound source deviated from the front center plane of the listener 102 to the left side or the right side were superimposed on an arbitrary acoustic signal (binauralization processing) and supplied to the left and right ears of the listener 102 by earphones 211L and 211R. At this moment, the auditory sense of the listener 102 was compared between a case where the first notch and the second notch of the HRTF on the side of the sound source was filled by a peaking equalizer (EQ) and a case where the first notch and the second notch of the HRTF on the side of the sound source was not filled.

In this drawing, an example in which the position of the sound source is at a front left upwardly oblique position of the listener 102, so that the left ear 103L of the listener 102 is on the side of the sound source and the right ear 103R is on the opposite side of the sound source is shown.

As a result, there was not a large difference between a position P1 of the sound image experienced by the listener 102 when the peaking EQ was turned off and a position P2 of the sound image experienced by the listener 102 when the peaking EQ was turned on. Further, it was found that an upside feeling of the sound image was not virtually degraded even when the first notch and the second notch of the HRTF on the side of the sound source was filled.

Figure 5:
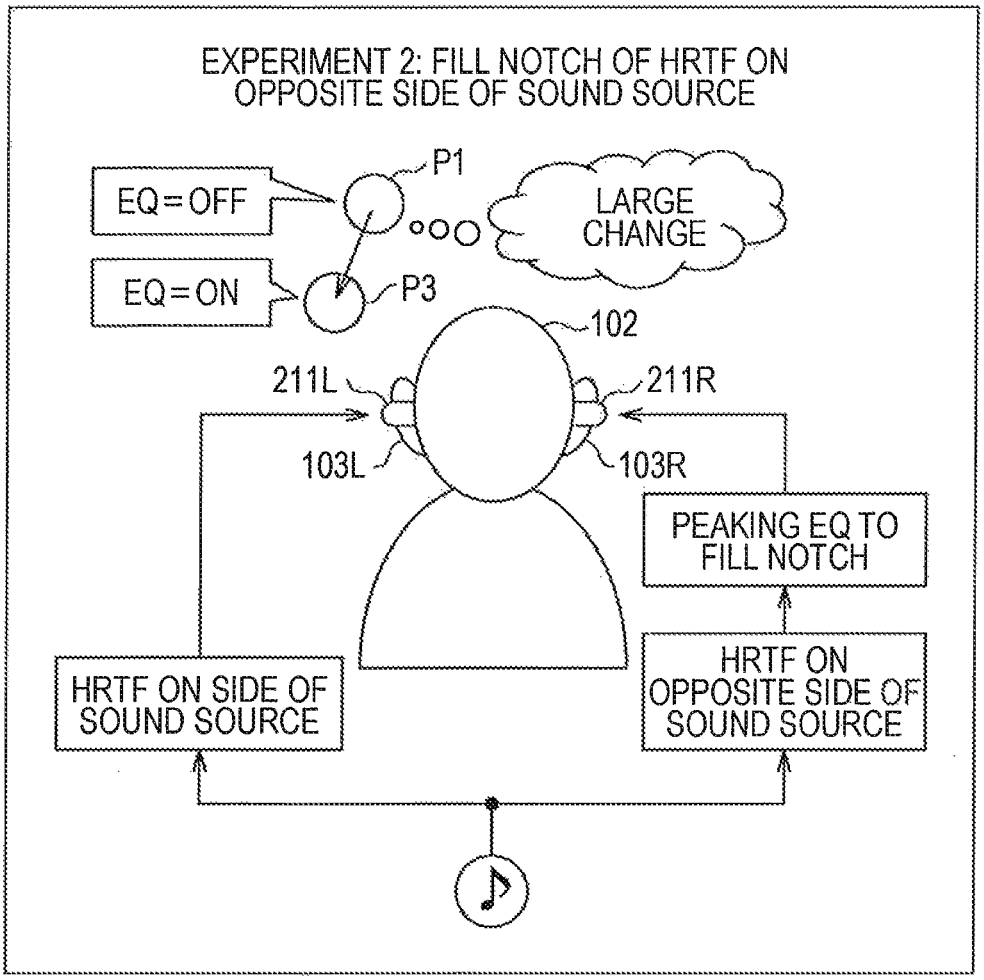
FIG. 5 is a schematic diagram for explaining an experiment for studying an influence of a notch of the HRTF on an opposite side of the sound source on an auditory sense of a listener.

An experiment was performed to study the influence of the first notch and the second notch of the HRTF on the opposite side of the sound source on the auditory sense of the listener in the similar method as the above. That is, as shown in FIG. 5, the auditory sense of the listener 102 was compared between a case where the first notch and the second notch of the HRTF on the opposite side of the sound source was filled by the peaking equalizer (EQ) and a case where the first notch and the second notch of the HRTF on the opposite side of the sound source was not filled.

As a result, there was a large difference between the position P1 of the sound image experienced by the listener 102 when the peaking EQ was turned off and the position P3 of the sound image experienced by the listener 102 when the peaking EQ was turned on. Further, it was found that the upside feeling of the sound image was significantly degraded when the first notch and the second notch of the HRTF on the opposite side of the sound source was filled.

From this experimental result, it is inferred that, when the position of the sound source is deviated from the front center plane of the listener to the left side or the right side, a reproduction of the first notch and the second notch appearing on the HRTF on the opposite side of the sound source is important for a feeling of the localization of sound of the sound image in the up-down direction. The same goes for the localization of sound of the sound image in the front-back direction.

Therefore, in the transaural playing method, it can be said that, if the first notch and the second notch of the HRTF on the opposite side of the sound source can be reproduced around the ear on the shadow side of the listener, the localization of sound of the sound image in the up-down and front-back directions can be stabilized. However, it is considered that this is not easy because of the following reason.

Focusing only on a band in which the first notch and the second notch of the HRTF on the opposite side of the sound source appear, it is required to reproduce a small signal level around the ear on the shadow side of the listener and to reproduce a larger signal level around the ear on the side of the sound source. This can be achieved if the crosstalk compensation processing ideally works; however, in a general listening environment, an error is likely to be generated. If an error is generated in the crosstalk, the first notch and the second notch of the HRTF on the opposite side of the sound source are filled due to an influence of the crosstalk, and hence they cannot be reproduced around the ear on the shadow side of the listener.

In this manner, it is of great difficulty to reproduce the first notch and the second notch of the HRTF on the opposite side of the sound source around the ear on the shadow side, and this is considered as one of the reasons that cause instability of the localization of sound of the sound image in the up-down and front-back direction.

In view of the above problem in the transaural playing system, another experiment was conducted.

Figure 6:
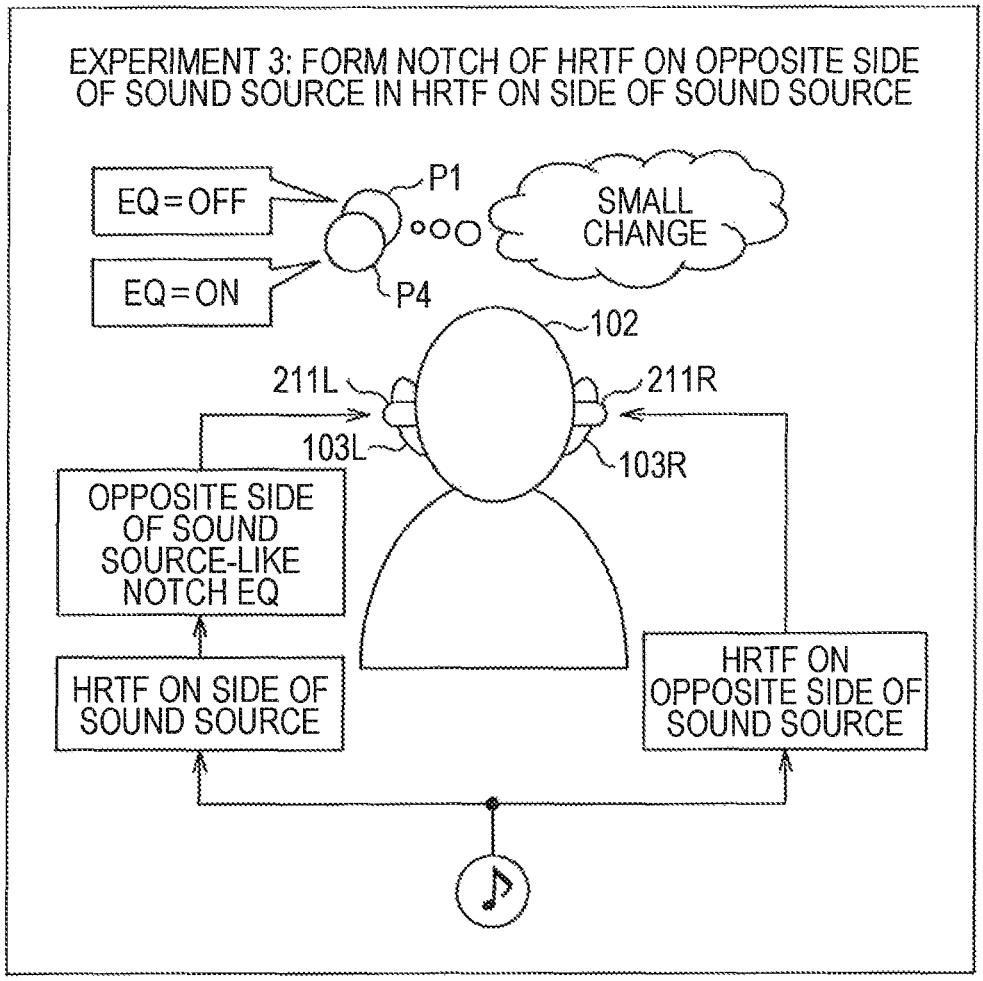
FIG. 6 is a schematic diagram for explaining an experiment for studying an influence on an auditory sense of a listener when a notch of the HRTF on the opposite side of the sound source is formed in the HRTF on the side of the sound source.

Specifically, as shown in FIG. 6, the auditory sense of the listener 102 was compared between a case where the first notch and the second notch of the HRTF on the opposite side of the sound source is formed on the HRTF on the side of the sound source by an opposite side of the sound source-like notch EQ and a case where the first notch and the second notch of the HRTF on the opposite side of the sound source is not formed.

As a result, there was not a large difference between a position P1 of the sound image experienced by the listener 102 when the opposite side of the sound source-like notch EQ was turned off and a position 24 of the sound image experienced by the listener 102 when the opposite side of the sound source-like notch EQ was turned on. Further, it was found that an upside feeling of the sound image was not virtually degraded even when the first notch and the second notch of the HRTF on the opposite side of the sound source was formed on the HRTF on the side of the sound source.

From the above experimental results, if the first notch and the second notch of the HRTF on the opposite side of the sound source can be reproduced around the ear on the shadow side of the listener, it is inferred that the amplitude of the sound in the band in which the notch around the ear on the side of the sound source appears does not exert a significant influence on the localization of sound of the sound image in the up-down direction. The same goes for the localization of sound of the sound image in the front-back direction.

Embodiments of the present technology described below were obtained by applying the characteristics of the HRTF presented by the above experimental results.

2. FIRST EMBODIMENT

An acoustic signal processing system according to a first embodiment to which the present technology is applied is described below with reference to FIGS. 7 and 8.

(Configuration Example of Acoustic Signal Processing System 301)

Figure 7:
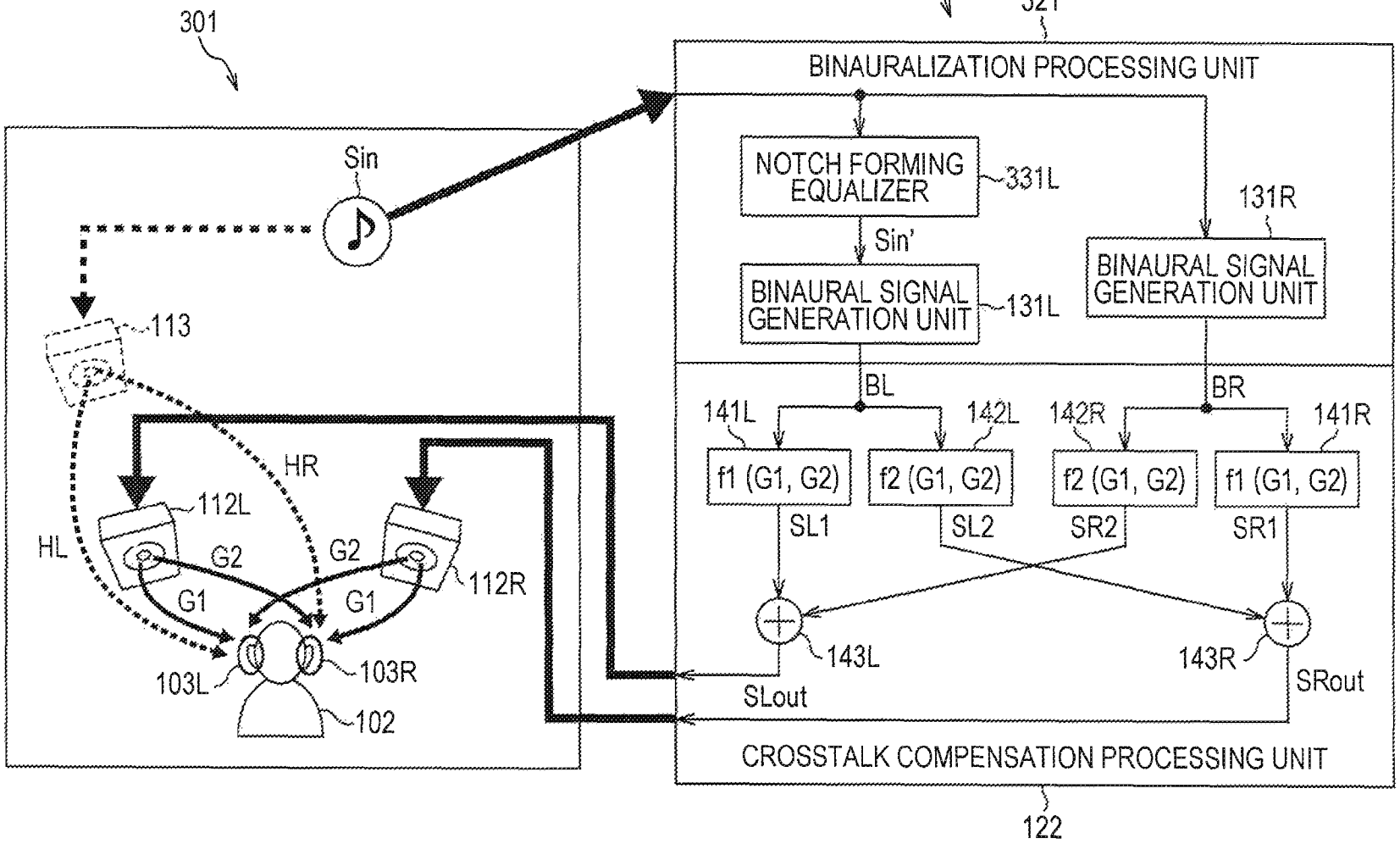
FIG. 7 is a schematic diagram showing an acoustic signal processing system according to a first embodiment to which the present technology is applied.

FIG. 7 is a schematic diagram showing a functional configuration example of an acoustic signal processing system 301 according to a first embodiment of the present technology. In the drawing, a portion corresponding to FIG. 2 is assigned with the same reference sign, and a description thereof is omitted as appropriate to obviate a redundant description.

The acoustic signal processing system 301 is different from the acoustic signal processing system 101 shown in FIG. 2 in that an acoustic signal processing unit 311 is provided in substitute for the acoustic signal processing unit 111. Further, the acoustic signal processing unit 311 is different from the acoustic signal processing unit ill in that a binauralization processing unit 321 is provided in substitute for the binauralization processing unit 121. Moreover, the binauralization processing unit 321 is different from the binauralization processing unit 121 in that a notch forming equalizer 331L is provided at a prior stage of the binaural signal generation unit 131L.

The notch forming equalizer 331L performs a processing of attenuating, among components of the acoustic signal Sin input from the outside, components in the band in which the first notch and the second notch of the HRTF on the opposite side of the sound source appear (hereinafter, referred to as a "notch forming processing"). The notch forming equalizer 331L supplies an acoustic signal Sin' obtained as a result of the notch forming processing to the binaural signal generation unit 131L.

In this example, a configuration in the case where the right ear 103R of the listener 102 is on the shadow side is described. On the other hand, when the left ear 103L of the listener 102 is on the shadow side, a notch forming equalizer 331R is provided at the prior stage of the binaural signal generation unit 131R instead of the notch forming equalizer 331L.

(Acoustic Signal Processing by Acoustic Signal Processing System 301)

An acoustic signal processing executed by the acoustic signal processing system 301 shown in FIG. 7 is described below with reference to a flowchart of FIG. 8.

In step S1, the notch forming equalizer 331L forms a notch of the same band as the notch of the HRTF on the opposite side of the sound source on the acoustic signal Sin on the side of the sound source. That is, the notch forming equalizer 331L attenuates, among the components of the acoustic signal Sin, components of the same band as the first notch and the second notch of the HRTF on the opposite side of the sound source. With this operation, among the components of the acoustic signal Sin, components of the lowest band and the second lowest band among bands in which a notch having a depth equal to or deeper than a predetermined depth appears on an amplitude of the HRTF on the opposite side of the sound source at a frequency equal to or higher than a predetermined frequency (frequency at which a positive peak appears in proximity of 4 kHz). The notch forming equalizer 331L then supplies the acoustic signal Sin' obtained as a result of this processing to the binaural signal generation unit 131L.

In step S2, each of the binaural signal generation units 131L and 131R performs a binauralization processing. Specifically, the binaural signal generation unit 131L generates the binaural signal BL by superimposing the head-related transfer function HL on the acoustic signal Sin' The binaural signal generation unit 131L supplies the generated binaural signal BL to the signal processing unit 141L and the signal processing unit 142L.

This binaural signal BL is a signal obtained by superimposing the HRTF on which the notch of the same band as the first notch and the second notch of the HRTF on the opposite side of the sound source is formed on the HRTF on the side of the sound source on the acoustic signal Sin. In other words, this binaural signal BL is a signal obtained by attenuating, among the components of the signal obtained by superimposing the HRTF on the side of the sound source on the acoustic signal Sin, the components of the band in which the first notch and the second notch of the HRTF on the opposite side of the sound source appear.

Further, the binaural signal generation unit 131R generates the binaural signal BR by superimposing the head-related transfer function HR on the acoustic signal Sin. The binaural signal generation unit 131R supplies the generated binaural signal BL to the signal processing unit 141R and the signal processing unit 142R.

In step S3, the crosstalk compensation processing unit 122 performs a crosstalk compensation processing. Specifically, the signal processing unit 141L generates an acoustic signal SL1 by superimposing the above-mentioned function f1(G1, G2) on the binaural signal BL. The signal processing unit 141L supplies the generated acoustic signal SL1 to the addition unit 143L.

Similarly, the signal processing unit 141R generates an acoustic signal SR1 by superimposing the function f1(G1, G2) on the binaural signal BR. The signal processing unit 141R supplies the generated acoustic signal SR1 to the addition unit 143R.

Further, the signal processing unit 142L generates an acoustic signal SL2 by superimposing the above-mentioned function f2(G1, G2) on the binaural signal BL. The signal processing unit 142L supplies the generated acoustic signal SL2 to the addition unit 143R.

Similarly, the signal processing unit 142R generates an acoustic signal SR2 by superimposing the function f2(G1, G2) on the binaural signal BR. The signal processing unit 142R supplies the generated acoustic signal SL2 to the addition unit 143L.

The addition unit 143L generates an acoustic signal SLout by adding the acoustic signal SL1 and acoustic signal SR2. The addition unit 143L supplies the generated acoustic signal SLout to the speaker 112L.

Similarly, the addition unit 143R generates an acoustic signal SRout by adding the acoustic signal SR1 and acoustic signal SL2. The addition unit 143R supplies the generated acoustic signal SRout to the speaker 112R.

In step S4, sounds based on the acoustic signal SLout and the acoustic signal SRout are output from the speaker 112L and the speaker 112R, respectively.

With this operation, focusing only on the band in which the first notch and the second notch of the HRTF on the opposite side of the sound source appear, signal levels of the reproduced sounds of the speakers 112L and 112R are decreased, and hence the level of the corresponding band is decreased in a stable manner in a sound that reaches both ears of the listener 102. Therefore, even if a crosstalk is generated, the first notch and the second notch of the HRTF on the opposite side of the sound source are stably reproduced around the ear on the shadow side of the listener 102. As a result, the instability of the localization of sound in the up-down and front-back directions, which is problematic in the transaural playing system, is resolved.

3. SECOND EMBODIMENT

An acoustic signal processing system according to a second embodiment to which the present technology is applied is described below with reference to FIGS. 9 and 10.

(Configuration Example of Acoustic Signal Processing System 401)

Figure 9:
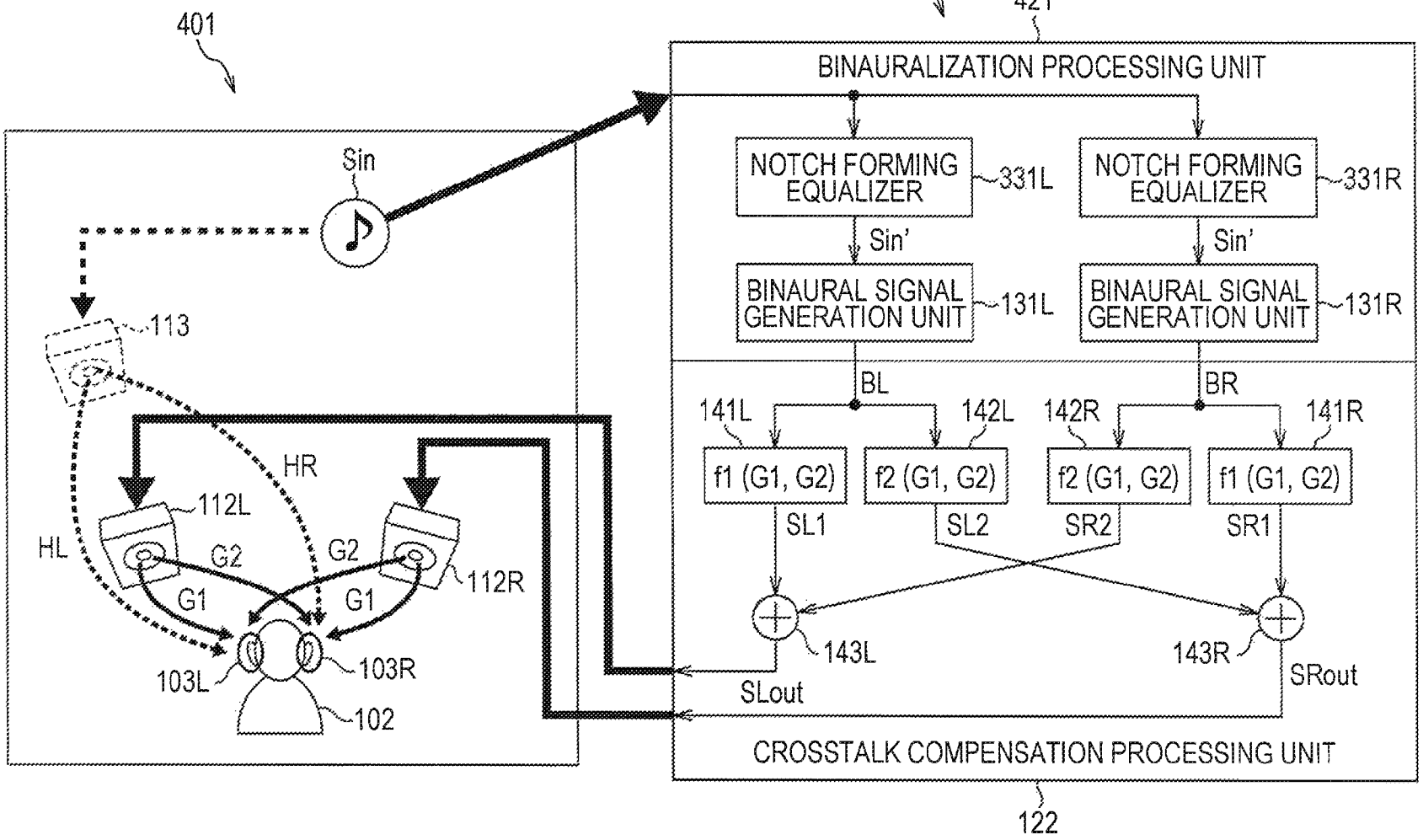
FIG. 9 is a schematic diagram showing an acoustic signal processing system according to a second embodiment to which the present technology is applied.
Figure 10:
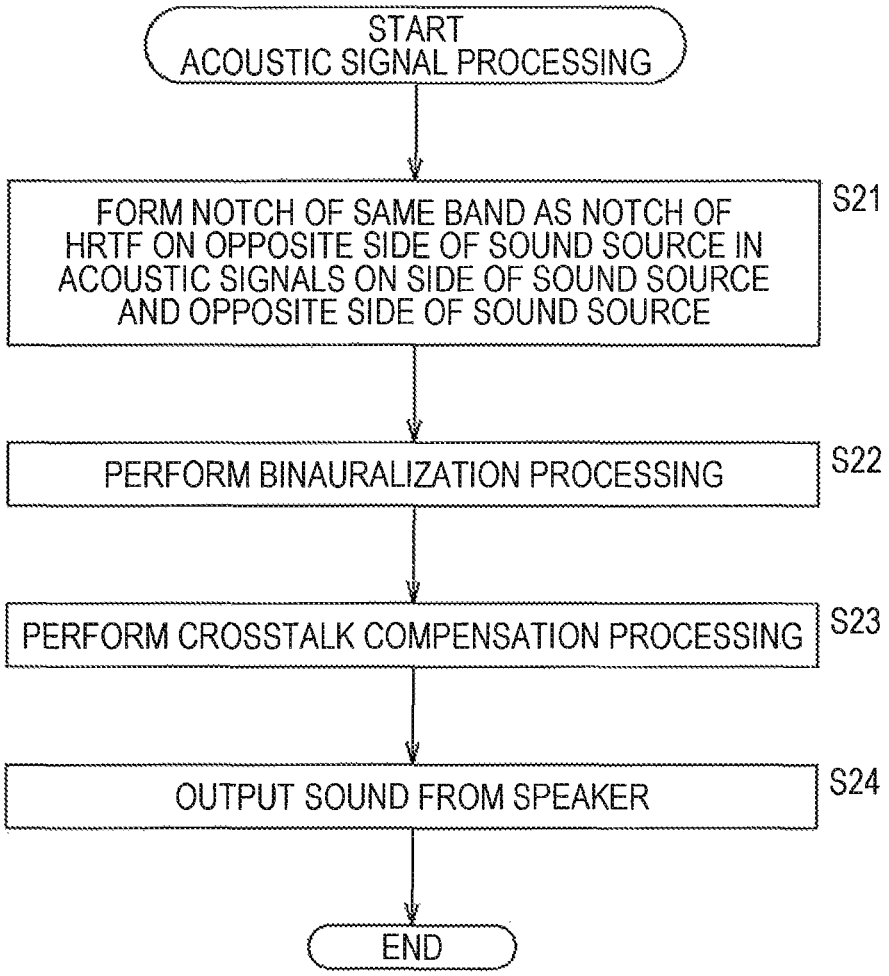
FIG. 10 is a flowchart for explaining an acoustic signal processing executed by the acoustic signal processing system according to the second embodiment.

FIG. 9 is a schematic diagram showing a functional configuration example of an acoustic signal processing system 401 according to the second embodiment of the present technology. In the drawing, a portion corresponding to FIG. 7 is assigned with the same reference sign, and a description thereof is omitted as appropriate to obviate a redundant description.

The acoustic signal processing system 401 is different from the acoustic signal processing system 301 shown in FIG. 7 in that an acoustic signal processing unit 411 is provided in substitute for the acoustic signal processing unit 311. Further, the acoustic signal processing unit 411 is different from the acoustic signal processing unit 311 in that a binauralization processing unit 421 is provided in substitute for the binauralization processing unit 321. Moreover, the binauralization processing unit 421 is different from the binauralization processing unit 321 in that a notch forming equalizer 331R is provided at a prior stage of the binaural signal generation unit 131R.

The notch forming equalizer 331R is an equalizer similar to the notch forming equalizer 331L. Therefore, an acoustic signal Sin' similar to that of the notch forming equalizer 331L is output from the notch forming equalizer 331R and is supplied to the binaural signal generation unit 131R.

(Acoustic Signal Processing by Acoustic Signal Processing System 401)

An acoustic signal processing executed by the acoustic signal processing system 401 of FIG. 9 is described below with reference to a flowchart of FIG. 10.

In step S21, each of the notch forming equalizers 331L and 331R forms a notch of the same band as the notch of the HRTF on the opposite side of the sound source on the acoustic signals Sin on the side of the sound source and the opposite side of the sound source. That is, the notch forming equalizer 331L attenuates, among the components of the acoustic signal Sin, the components of the same band as the first notch and the second notch of the HRTF on the opposite side of the sound source. The notch forming equalizer 331L then supplies the acoustic signal Sin' obtained as a result of the attenuation to the binaural signal generation unit 131L.

Similarly, the notch forming equalizer 331R attenuates, among the components of the acoustic signal Sin, the components of the same band as the first notch and the second notch of the HRTF on the opposite side of the sound source. The notch forming equalizer 331R then supplies the acoustic signal Sin' obtained as a result of the attenuation to the binaural signal generation unit 131R.

In step S22, each of the binaural signal generation units 131L and 131R performs a binauralization processing. Specifically, the binaural signal generation unit 131L generates the binaural signal BL by superimposing the head-related transfer function HL on the acoustic signal Sin'. The binaural signal, generation unit 131L supplies the generated binaural signal BL to the signal processing unit 141L and the signal processing unit 142L.

Similarly, the binaural signal generation unit 131R generates the binaural signal BR by superimposing the head-related transfer function HR on the acoustic signal Sin'. The binaural signal generation unit 131R supplies the generated binaural signal BR to the signal processing unit 141R and the signal processing unit 142R.

This binaural signal BR is a signal obtained by superimposing a HRTF in which the first notch and the second notch of the HRTF on the opposite side of the sound source are substantially deepened on the acoustic signal Sin. Therefore, in this binaural signal BR, the components of the band in which the first notch and the second notch of the HRTF on the opposite side of the sound source appear are further decreased, compared to the binaural signal BR in the acoustic signal processing system 301.

Figure 8:
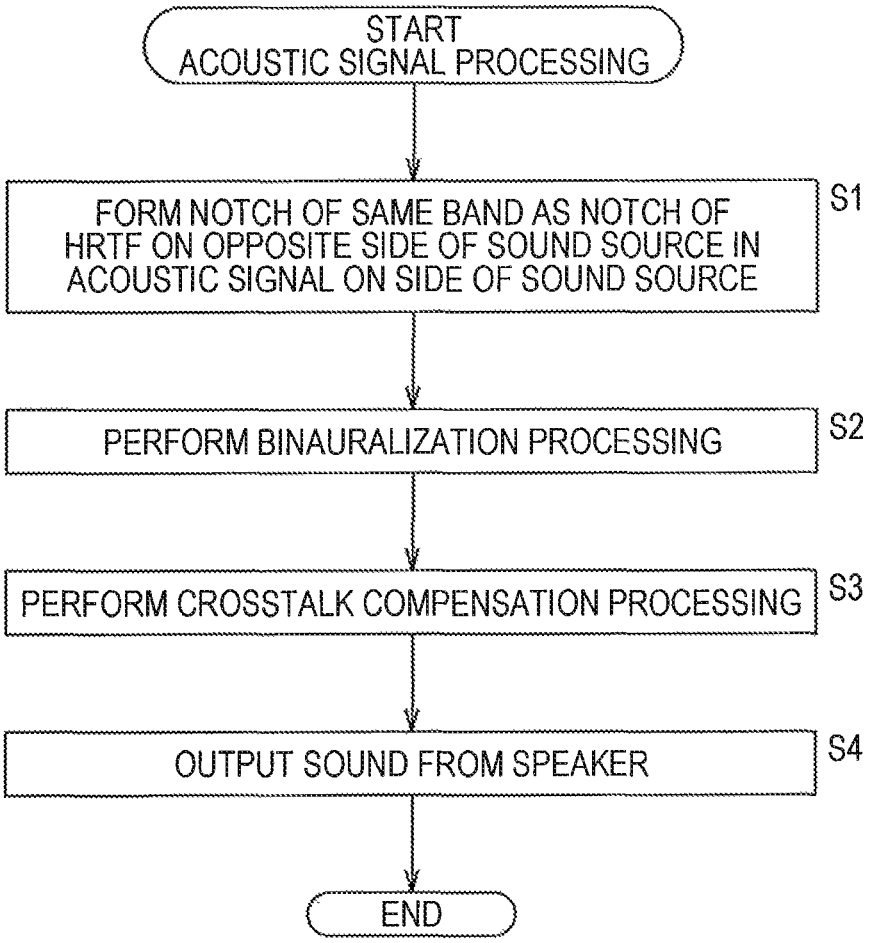
FIG. 8 is a flowchart for explaining an acoustic signal processing executed by the acoustic signal processing system according to the first embodiment.

Thereafter, in step S23, a crosstalk compensation processing is performed in a similar manner to the processing of Step S3 in FIG. 8, and in step S24, sounds are output from the speakers 112L and 112R as in a similar manner to the processing of Step S4 in FIG. 8, by which the acoustic signal processing is ended.

As described above, in the acoustic signal processing system 401, the components of the band in which the first notch and the second notch of the HRTF on the opposite side of the sound source appear are decreased in the binaural signal BR, compared to the acoustic signal processing system 301. Therefore, components of the same band as the acoustic signal SRout finally supplied to the speaker 112R are decreased, and the level of the same band of the sound output from the speaker 112R is also decreased.

However, this does not exert a negative influence in terms of stably reproducing the level of the band of the first notch and the second notch of the HRTF on the opposite side of the sound source around the ear on the shadow side of the listener 102. Therefore, in the acoustic signal processing system 401, the localization of sound in the up-down and front-back directions can be stabilized in a similar manner to the acoustic signal processing system 301.

Further, as the level of the band of the first notch and the second notch of the HRTF on the opposite side of the sound source is inherently small in the sound reaching around both ears of the listener 102, a further decrease of the level does not exert a negative influence on the sound quality.

4. THIRD EMBODIMENT

An acoustic signal processing system according to a third embodiment to which the present technology is applied is described below with reference to FIGS. 11 and 12.

(Configuration Example of Acoustic Signal Processing System 501)

Figure 11:
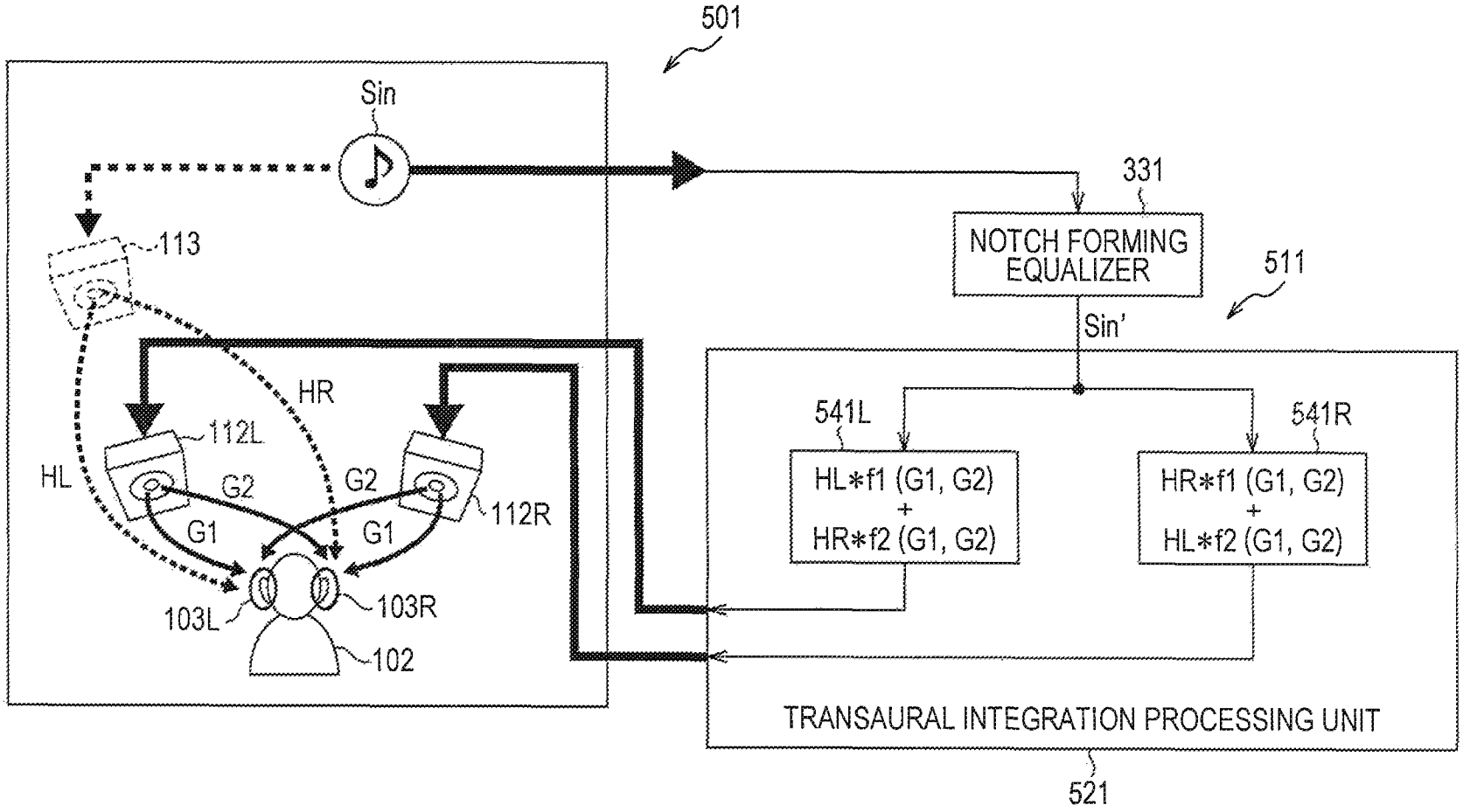
FIG. 11 is a schematic diagram showing an acoustic signal processing system according to a third embodiment to which the present technology is applied.
Figure 12:
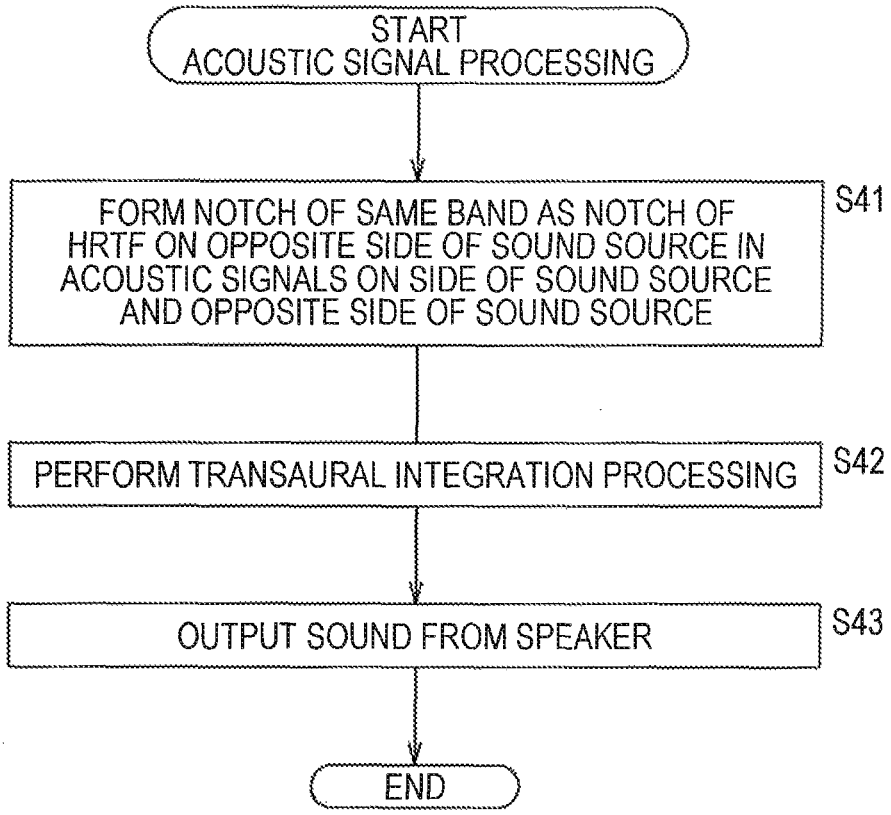
FIG. 12 is a flowchart for explaining an acoustic signal processing executed by the acoustic signal processing system according to the third embodiment.

FIG. 11 is a schematic diagram showing a functional configuration example of an acoustic signal processing system 501 according to the third embodiment of the present technology. In the drawing, a portion corresponding to FIG. 9 is assigned with the same reference sign, and a description thereof is omitted as appropriate to obviate a redundant description.

The acoustic signal processing system 501 shown in FIG. 11 is different from the acoustic signal processing system 401 shown in FIG. 9 in that an acoustic signal processing unit 511 is provided in substitute for the acoustic signal processing unit 411. The acoustic signal processing unit 511 includes a notch forming equalizer 331 and a transaural integration processing unit 521. The transaural integration processing unit 521 includes signal processing units 541L and 541R.

The notch forming equalizer 331 is an equalizer similar to the notch forming equalizers 331L and 331R shown in FIG. 9. Therefore, the acoustic signal Sin' similar to that of the notch forming equalizers 331L and 331R is output from the notch forming equalizer 331 and is supplied to the signal processing units 541L and 541R.

The transaural integration processing unit 521 performs an integration processing of integrating the binauralization processing and the crosstalk compensation processing on the acoustic signal Sin'. For example, the signal processing unit 541L performs a processing represented by following Equation (3) on the acoustic signal Sin', and generates an acoustic signal SLout.

$$SLout=\{HL/f1(G1,G2)+HR*f2(G1,G2)\}\times Sin' \quad (3)$$

This acoustic signal SLout is a signal similar to the acoustic signal SLout in the acoustic signal processing system 401.

Similarly, for example, the signal processing unit 541R performs a processing represented by following Equation (4) on the acoustic signal Sin', and generates an acoustic signal SRout.

$$SRout=\{HR*f1(G1,G2)+HL*f2(G1,G2)\}\times Sin' \quad (4)$$

This acoustic signal SRout is a signal similar to the acoustic signal SRout in the acoustic signal processing system 401.

In this manner, in the transaural playing system, the integration of the binauralization processing and the crosstalk compensation processing is often performed in order to reduce a load of the signal processing.

Further, upon implementing this integration processing, the signal processing units 541L and 541R are normally configured with a finite impulse response (FIR) filter, because a frequency characteristic of a signal to be processed is generally complicated.

At this moment, there is no problem if a signal processing resource that can perform a higher order processing to enable a sufficient reproduction of a characteristic in which the binauralization processing and the crosstalk compensation processing are combined is ensured in the FIR filter. However, in general, only a signal processing resource that can perform a lower-order processing than a necessary order is ensured in most cases.

In this type of lower-order FIR filter, it is difficult to ensure a characteristic of a portion where an amplitude (gain) is lower than its periphery, in particular, among amplitude-frequency characteristics. For example, due to the lower-order processing, a shape of a dip appearing on the amplitude-frequency characteristics is degraded, or a shift of a frequency is generated.

Therefore, when the signal processing units 541L and 541R are mounted as a lower-order FIR filter, merging of the processing of the notch forming equalizer 331 in the signal processing units 541L and 541R makes it difficult to ensure a characteristic of a notch to be formed. In contrast to this, by implementing the notch forming equalizer 331 on outer sides of the signal processing units 541L and 541R as an infinite impulse response (IIR) filter, the characteristic of the notch to be formed by the notch forming equalizer 331 can be more stably ensured.

On the other hand, when the notch forming equalizer 331 is mounted on the outer side of the signal processing units 541L and 541R, no path exists for performing a notch forming processing only on the acoustic signal Sin on the side of the sound source. Therefore, in the acoustic signal processing unit 511, the notch forming equalizer 331 is provided at a prior stage of the signal processing unit 541L and the signal processing unit 541R, the notch forming processing is performed with respect to the acoustic signal Sin on both the side of the sound source and the opposite side of the sound source, and the obtained signal is supplied to the signal processing units 541L and 541R. That is, in a similar manner to the acoustic signal processing system 401, an HRTF in which the first notch and the second notch of the HRTF on the opposite side of the sound source are substantially more deepened is superimposed with respect to the acoustic signal Sin on the opposite side of the sound source.

However, as described above, even when the first notch and the second notch of the HRTF on the opposite side of the sound source is more deepened, there is no negative influence on the localization of sound and the sound quality in the up-down and front-back directions. Rather, when a dip of the amplitude-frequency characteristics is degraded due to the signal processing unit 541L and the signal processing unit 541R being configured with the lower-order FIR filter, aggressively deepening the first notch and the second notch of the HRTF on the opposite side of the sound source may be effective.

(Acoustic Signal Processing by Acoustic Signal Processing System 501)

An acoustic signal processing executed by the acoustic signal processing system 501 of FIG. 11 is described below with reference to a flowchart of FIG. 12.

In step S41, the notch forming equalizer 331 forms a notch of the same band as the notch of the HRTF on the opposite side of the sound source on the acoustic signals Sin on the side of the sound source and the opposite side of the sound source. That is, the notch forming equalizer 331 attenuates, among the components of the acoustic signals Sin, the components of the same band as the first notch and the second notch of the HRTF on the opposite side of the sound source. The notch forming equalizer 331 supplies the acoustic signal Sin' obtained as a result of the attenuation to the signal processing units 541L and 541R.

In step S42, the transaural integration processing unit 521 performs a transaural integration processing. Specifically, as described above with respect to FIG. 11, the signal processing unit 541L performs the binauralization processing and the crosstalk compensation processing for generating the acoustic signal to be output from the speaker 112L on the acoustic signal Sin' in an integrated manner, generates the acoustic signal SLout, and supplies the acoustic signal SLout to the speaker 112L. Similarly, as described above with respect to FIG. 11, the signal processing unit 541R performs the binauralization processing and the crosstalk compensation processing for generating the acoustic signal to be output from the speaker 112R on the acoustic signal Sin' in an integrated manner, generates the acoustic signal SRout, and supplies the acoustic signal SRout to the speaker 112R.

In step S43, in a similar manner to the processing of Step S4 in FIG. 8, the sound is output from the speakers 112L and 112R, by which the acoustic signal processing is ended.

With this operation, in the acoustic signal processing system 501 as well, for the same reason advanced with respect to the acoustic signal processing system 401, the localization of sound in the up-down and front-back directions can be stabilized. Further, compared to the acoustic signal processing system 401, a reduction of the load of the signal processing can be generally expected.

5. MODIFICATION EXAMPLES

Modification examples of the embodiments of the present technology are described below.

Modification Example 1

Case of Generating a Plurality of Virtual Speakers

In the above descriptions, an example in which only one virtual speaker (virtual sound source) is generated is described. On the other hand, in a case of generating two or more virtual speakers, for example, it suffices to provide acoustic signal processing units 311 as the one shown in FIG. 7, acoustic signal processing units 411 as the one shown in FIG. 9, or acoustic signal processing unit 511 as the one shown in FIG. 11 for each of the virtual speakers in parallel.

In the case of providing the acoustic signal processing units 311 in parallel, for example, it suffices to apply the HRTF on the side of the sound source and the HRTF on the opposite side of the sound source corresponding to the virtual speaker to each of the acoustic signal processing units 311. Among acoustic signals output from the acoustic signal processing units 311, acoustic signals for a left speaker are summed and supplied to the left speaker, and acoustic signals for a right speaker are summed and supplied to the right speaker.

Further, in this case, only the binauralization processing unit 321 can be provided for each virtual speaker, so that the crosstalk compensation processing unit 122 can be shared.

Moreover, similarly in the case of providing the acoustic signal processing units 411 in parallel, for example, it suffices to apply the HRTF on the side of the sound source and the HRTF on the opposite side of the sound source corresponding to the virtual speaker to each of the acoustic signal processing units 411. Among acoustic signals output from the acoustic signal processing units 411, acoustic signals for a left speaker are summed and supplied to the left speaker, and acoustic signals for a right speaker are summed and supplied to the right speaker.

Further, in this case as well, only the binauralization processing unit 421 can be provided for each virtual speaker, so that the crosstalk compensation processing unit 122 can be shared.

Moreover, in the case of providing the acoustic signal processing units 511 in parallel, for example, it suffices to apply the HRTF on the side of the sound source and the HRTF on the opposite side of the sound source corresponding to the virtual speaker to each of the acoustic signal processing units 511. Among acoustic signals output from the acoustic signal processing units 511, acoustic signals for a left speaker are summed and supplied to the left speaker, and acoustic signals for a right speaker are summed and supplied to the right speaker.

Figure 13:
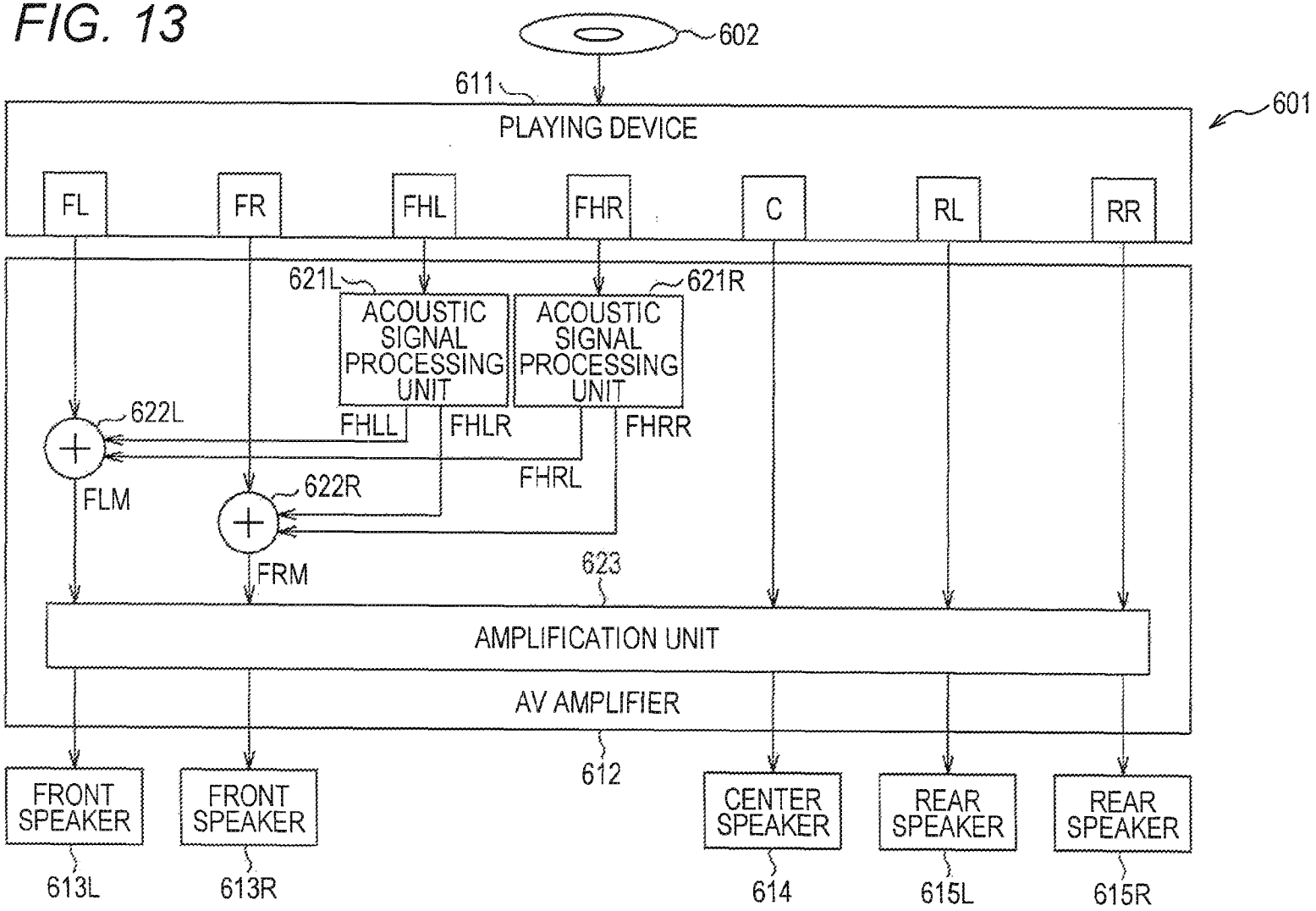
FIG. 13 is a schematic diagram showing a functional configuration example of an audio system to which the present technology is applied.

FIG. 13 is a block diagram for schematically showing a functional configuration example of an audio system 601 configured to output a virtual sound from two virtual speakers at two positions of a front left upwardly oblique position and a front right upwardly oblique position of a predetermined listening position by using left and right front speakers.

The audio system 601 includes a player device 611, an audio/visual (AV) amplifier 612, front speakers 613L and 613R, a center speaker 614, and rear speakers 615L and 615R.

The player device 611 is a player device that can play at least a six-channel acoustic signal having channels of front left, front right, front center, rear left, rear right, front left upward, and front right upward. For example, the player device 611 outputs a front left acoustic signal FL, a front right acoustic signal FR, a front center acoustic signal C, a rear left acoustic signal RL, a rear right acoustic signal RR, a front left upwardly oblique acoustic signal FHL, and a front right upwardly oblique acoustic signal FHR obtained by playing a six-channel acoustic signal recorded in a recording medium 602.

The AV amplifier 612 includes acoustic signal processing units 621L and 621R, addition units 622L and 622R, and an amplifier unit 623.

The acoustic signal processing unit 621L is configured with the acoustic signal processing unit 311 shown in FIG. 7, the acoustic signal processing unit 411 shown in FIG. 9, or the acoustic signal processing unit 511 shown in FIG. 11. The acoustic signal processing unit 621L corresponds to the front left upwardly oblique virtual speaker, to which the HRTF on the side of the sound source and the HRTF on the opposite side of the sound source corresponding to the virtual speaker are applied.

The acoustic signal processing unit 621L performs the acoustic signal processing described above with reference to FIG. 8, 10, or 12 on the acoustic signal FHL, and generates acoustic signals FHLL and FHLR obtained as a result of the acoustic signal processing. The acoustic signal processing unit 621L supplies the acoustic signal FHLL to the addition unit 622L and supplies the acoustic signal FHLR to the addition unit 622R.

The acoustic signal processing unit 621R is configured with, in a similar manner to the acoustic signal processing unit 621L, the acoustic signal processing unit 311 shown in FIG. 7, the acoustic signal processing unit 411 shown in FIG. 9, or the acoustic signal processing unit 511 shown in FIG. 11. The acoustic signal processing unit 621R corresponds to the front right upwardly oblique virtual speaker, to which the HRTF on the side of the sound source and the HRTF on the opposite side of the sound source corresponding to the virtual speaker are applied.

The acoustic signal processing unit 621R performs the acoustic signal processing described above with reference to FIG. 8, 10, or 12 on the acoustic signal FHR, and generates acoustic signals FHRL and FHRR obtained as a result of the acoustic signal processing. The acoustic signal processing unit 621L supplies the acoustic signal FHRL to the addition unit 622L and supplies the acoustic signal FHRR to the addition unit 622R.

The addition unit 622L generates an acoustic signal FLM by summing the acoustic signal FL, the acoustic signal FHLL, and the acoustic signal FHRL, and supplies the acoustic signal FLM to the amplifier unit 623.

The addition unit 622L generates an acoustic signal FRM by summing the acoustic signal FR, the acoustic signal FHLR, and the acoustic signal FHRR, and supplies the acoustic signal FRM to the amplifier unit 623.

The amplifier unit 623 amplifies the acoustic signal FLM to acoustic signal RR, and supplies the amplified signals to the front speaker 613L to the rear speaker 615R, respectively.

The front speaker 613L and the front speaker 613R are arranged, for example, symmetrically in front of a predetermined listening position. The front speaker 613L outputs a sound based on the acoustic signal FLM, and the front speaker 613R outputs a sound based on the acoustic signal FRM. With this operation, a listener at the listening position experiences that the sound is output from the virtual speakers virtually arranged at two positions of the front left upwardly oblique position and the front right upwardly oblique position, as well as the front speakers 613L and 613R.

The center speaker 614 is arranged at, for example, the front center of the listening position. The center speaker 614 outputs a sound based on the acoustic signal C.

The rear speaker 615L and the rear speaker 615R are arranged, for example, symmetrically behind the listening position. The rear speaker 615L outputs a sound based on the acoustic signal RL, and the rear speaker 615R outputs a sound based on the acoustic signal RR.

Modification Example 2

Example of Modifying Configuration of Acoustic Signal Processing Unit

Further, for example, the notch forming equalizer 331L and the binaural signal generation unit 131L can be changed in order in the binauralization processing unit 321 shown in FIG. 7. Similarly, the notch forming equalizer 331L and the binaural signal generation unit 131L can be changed in order and the notch forming equalizer 331R and the binaural signal generation unit 131R can be changed in order in the binauralization processing unit 421 shown in FIG. 9.

Moreover, for example, the notch forming equalizer 331L and the notch forming equalizer 331R can be integrated into one in the binauralization processing unit 421 shown in FIG. 9.

Modification Example 3

Example of Modifying Position of Virtual Speaker

The above descriptions are mainly about the case where the virtual speaker is arranged at the front left upwardly oblique position of the listening position. However, the present technology is effective in all cases where the virtual speaker is arranged at a position deviated from the front center plane of the listening position to the left side or the right side. For example, the present technology is also effective in a case where the virtual speaker is arranged at a rear left upwardly oblique position or a rear right upwardly oblique position of the listening position. Further, for example, the present technology is also effective in a case where the virtual speaker is arranged at a front left downwardly oblique position or a front right downwardly oblique position of the listening position, and is arranged at a rear left downwardly oblique position or a rear right downwardly oblique position of the listening position. Moreover, for example, the present technology is also effective in a case where the virtual speaker is arranged in front of or behind an actual speaker or left or right of the actual speaker.

Modification Example 4

Example of Modifying Arrangement of Speaker Used to Generate Virtual Speaker Further, the above descriptions are about the case of generating the virtual speaker by using the speakers arranged symmetrically in front with respect to the listening position in order to simplify explanations. However, in the present technology, the speakers are not necessarily to be arranged symmetrically in front with respect to the listening position. For example, the speakers can be arranged asymmetrically in front with respect to the listening position. Moreover, in the present technology, the speakers are not necessarily to be arranged in front of the listening position, but can be arranged at a position other than the front of the listening position (for example, behind the listening position). In addition, the function used for the crosstalk compensation processing needs to be changed as appropriate depending on a place for arranging the speakers.

The present technology can be applied to, for example, various devices and systems for achieving the virtual surround system, such as the above-mentioned AV amplifier.

(Configuration Example of Computer)

A series of processings described above can be executed by hardware or can be executed by software. When the series of processings are executed by the software, a program constituting the software is installed in a computer. The computer includes a computer that is incorporated in dedicated hardware, a computer that can execute various functions by installing various programs, such as a general personal computer, and the like.

Figure 14:
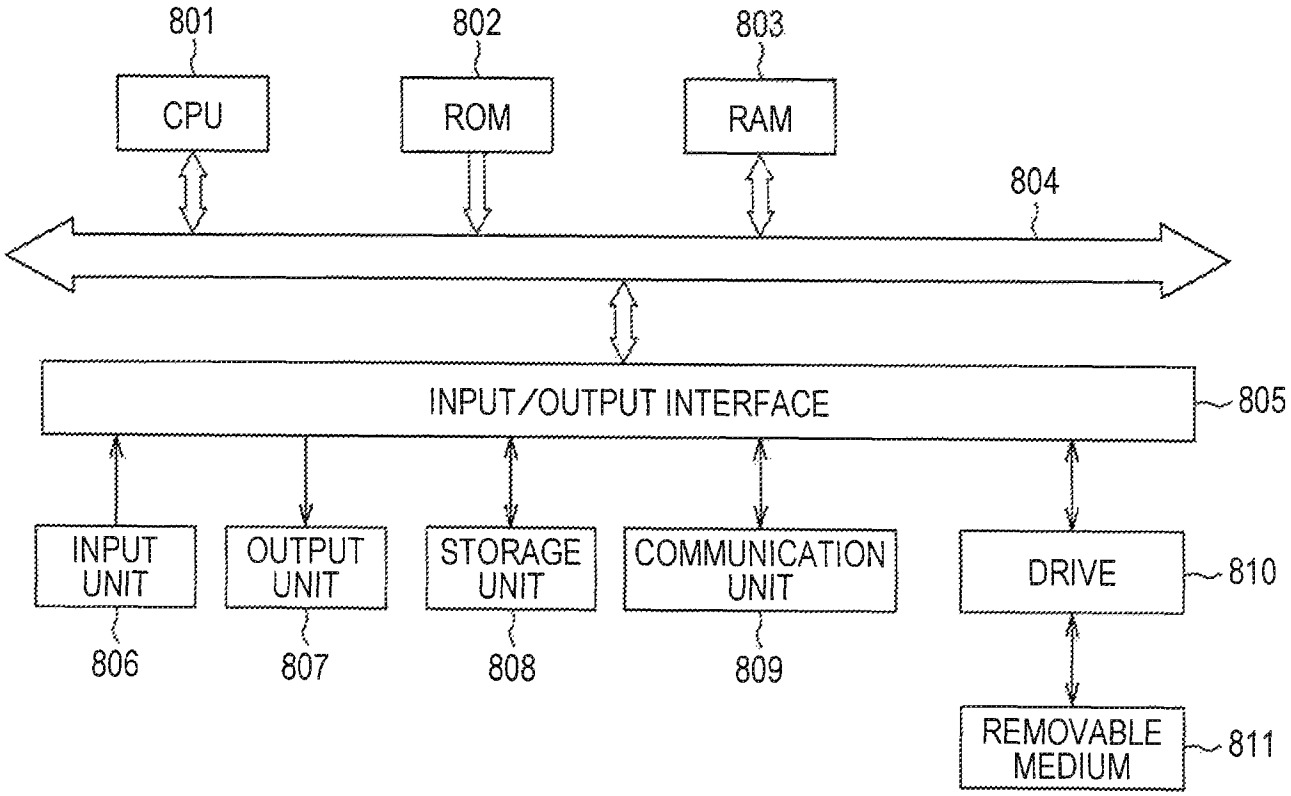
FIG. 14 is a block diagram showing a configuration example of a computer.

FIG. 14 is a block diagram showing a configuration example of hardware of a computer for executing the series of processings described above with a program.

In the computer, a central processing unit (CPU) 801, a read only memory (ROM) 802, and a random access memory (RAM) 803 are connected to one another via a bus 804.

An input/output interface 805 is connected to the bus 804. An input unit 806, an output unit 807, a storage unit 808, a communication unit 809, and a drive 810 are connected to the input/output interface 805.

The input unit 806 includes a keyboard, a mouse, a microphone, and the like. The output unit 807 includes a display, a speaker, and the like. The storage unit 808 includes a hard disk, a nonvolatile memory, and the like. The communication unit 809 includes a network interface and the like. The drive 810 drives a removable medium 811 such as a magnetic disk, an optical disk, a magneto-optical disk, or a semiconductor memory.

In the computer configured in the above manner, for example, the series of processings described above are performed by, for example, the CPU 801 loading the program stored in the storage unit 808 to the RAM 803 via the input/output interface 805 and the bus 804 and executing the program.

The program executed by the computer (CPU 801) can be provided by, for example, being recorded in the removable medium 811 as a packaged medium. Further, the program can be provided via a wired or wireless transmission medium such as a local area network, the Internet, and a digital satellite broadcasting.

In the computer, the program can be installed in the storage unit 808 via the input/output interface 805 by an action of inserting the removable medium 811 in the drive 810. Further, the program can be received by the communication unit 809 via a wired or wireless transmission medium and installed in the storage unit 808. Moreover, the program can be installed in advance in the ROM 802 or the storage unit 808.

The program executed by the computer can be a program for which processings are performed in a chronological order along a sequence described in this specification or can be a program for which processings are performed in parallel or at appropriate timings when called.

Further, in this specification, the system means a set of a plurality of constituent elements (devices, modules (parts), and the like), and it is no object whether all the constituent elements are in the same casing or not. Therefore, both a plurality of devices accommodated in separate casings and connected via a network and a single device including a plurality of modules accommodated in a single casing are systems.

Further, embodiments of the present technology are not limited to the above-mentioned embodiments, but various modifications may be made without departing from the gist of the present technology.

For example, the present technology can adopt a cloud computing configuration in which a single function is processed by a plurality of devices via a network in a distributed and shared manner.

Moreover, the steps described in the above-mentioned flowcharts can be executed by a single device or can be executed by a plurality of devices in a distributed manner.

Further, when a single step includes a plurality of processings, the plurality of processings included in the single step can be executed by a single device or can be executed by a plurality of devices in a distributed manner.

Moreover, for example, the present technology can adopt the following configurations.

(1)

An acoustic signal processing apparatus, including:

a first binauralization processing unit configured to generate a first binaural signal by superimposing a first head-related transfer function between a virtual sound source deviated from a front center plane at a predetermined listening position to a left side or a right side and a first ear on a far side from the virtual sound source at the listening position on an acoustic signal;

a second binauralization processing unit configured to generate a second binaural signal by attenuating, among components of a signal obtained by superimposing a second head-related transfer function between the virtual sound source and a second ear on a near side to the virtual sound source at the listening position on the acoustic signal, components of a first band and a second band, the first band and the second band being a lowest band and a second lowest band, respectively, among bands in which a negative peak having a depth equal to or deeper than a predetermined depth appears on an amplitude of the first head-related transfer function at a frequency equal to or higher than a predetermined frequency; and a crosstalk compensation processing unit configured to perform a crosstalk compensation processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

(2)

The acoustic signal processing apparatus according to (1), wherein the first binauralization processing unit is configured to generate a third binaural signal by attenuating Components of the first band and the second band among components of the first binaural signal, and the crosstalk compensation processing unit is configured to perform the crosstalk compensation processing with respect to the second binaural signal and the third binaural signal.

(3)

The acoustic signal processing apparatus according to (1) or (2), wherein the predetermined frequency is a frequency at which a positive peak appears in proximity of 4 kHz of the first head-related transfer function.

(4)

An acoustic signal processing method, including:

generating a first binaural signal by superimposing a first head-related transfer function between a virtual sound source deviated from a front center plane at a predetermined listening position to a left side or a right side and a first ear on a far side from the virtual sound source at the listening position on an acoustic signal;

generating a second binaural signal by attenuating, among components of a signal obtained by superimposing a second head-related transfer function between the virtual sound source and a second ear on a near side to the virtual sound source at the listening position on the acoustic signal, components of a first band and a second band, the first band and the second band being a lowest band and a second lowest band, respectively, among bands in which a negative peak having a depth equal to or deeper than a predetermined depth appears on an amplitude of the first head-related transfer function at a frequency equal to or higher than a predetermined frequency; and performing a crosstalk compensation processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

(5)

A program for causing a computer to execute:

generating a first binaural signal by superimposing a first head-related transfer function between a virtual sound source deviated from a front center plane at a predetermined listening position to a left side or a right side and a first ear on a far side from the virtual sound source at the listening position on an acoustic signal;

generating a second binaural signal by attenuating, among components of a signal obtained by superimposing a second head-related transfer function between the virtual sound source and a second ear on a near side to the virtual sound source at the listening position on the acoustic signal, components of a first band and a second band, the first band and the second band being a lowest band and a second lowest band, respectively, among bands in which a negative peak having a depth equal to or deeper than a predetermined depth appears on an amplitude of the first head-related transfer function at a frequency equal to or higher than a predetermined frequency; and performing a crosstalk compensation processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

(6)

A computer-readable recording medium that stores therein a program according to (5).

(7)

An acoustic signal processing apparatus, including:

an attenuation unit configured to generate a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency; and a signal processing unit configured to perform, in an integrated manner, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal, and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

(8)

The acoustic signal processing apparatus according to (7), wherein the predetermined frequency is a frequency at which a positive peak appears in proximity of 4 kHz of the first head-related transfer function.

(9)

The acoustic signal processing apparatus according to (7) or (8), wherein the attenuation unit includes an infinite impulse response (IR) filter, and the signal processing unit includes a finite impulse response (FIR) filter.

(10)

An acoustic signal processing method, including:

generating a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency; and performing, in an integrated manner, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal, and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

(11)

A program for causing a computer to execute:

generating a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency; and performing, in an integrated manner, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal, and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

(12)

A computer-readable recording medium that stores therein a program according to (11).

REFERENCE SIGNS LIST

101 Acoustic signal processing system
102 Listener
103L, 103R Ears
111 Acoustic signal processing unit
112L, 112R Speakers
113 Virtual speaker
121 Binauralization processing unit
122 Crosstalk compensation processing unit
131L, 131R Binaural signal generation units
141L to 142R Signal processing units
143L, 143R Addition units
301 Acoustic signal processing system
311 Acoustic signal processing unit
321 Binauralization processing unit
331, 331L, 331R Notch forming equalizers
401 Acoustic signal processing system
411 Acoustic signal processing unit
421 Binauralization processing unit
501 Acoustic signal processing system
511 Acoustic signal processing unit
521 Transaural integration processing unit
541L, 541R Signal processing units
601 Audio system
612 AV amplifier
621L, 621R Acoustic signal processing units
622L, 622R Addition units

The invention claimed is:

1. An acoustic signal processing apparatus, comprising:

a first binauralization processing unit configured to generate a first binaural signal by superimposing a first head-related transfer function between a virtual sound source deviated from a front center plane at a predetermined listening position to a left side or a right side and a first ear on a far side from the virtual sound source at the listening position on an acoustic signal;

a second binauralization processing unit configured to generate a second binaural signal by attenuating, among components of a signal obtained by superimposing a second head-related transfer function between the virtual sound source and a second ear on a near side to the virtual sound source at the listening position on the acoustic signal, components of a first band and a second band, the first band and the second band being a lowest band and a second lowest band, respectively, among bands in which a negative peak having a depth equal to or deeper than a predetermined depth appears on an amplitude of the first head-related transfer function at a frequency equal to or higher than a predetermined frequency; and a crosstalk compensation processing unit configured to perform a crosstalk compensation processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

2. The acoustic signal processing apparatus according to claim 1, wherein the first binauralization processing unit is configured to generate a third binaural signal by attenuating components of the first band and the second band among components of the first binaural signal, and the crosstalk compensation processing unit is configured to perform the crosstalk compensation processing with respect to the second binaural signal and the third binaural signal.

3. The acoustic signal processing apparatus according to claim 1, wherein the predetermined frequency is a frequency at which a positive peak appears in proximity of 4 kHz of the first head-related transfer function.

4. An acoustic signal processing method, comprising:

generating a first binaural signal by superimposing a first head-related transfer function between a virtual sound source deviated from a front center plane at a predetermined listening position to a left side or a right side and a first ear on a far side from the virtual sound source at the listening position on an acoustic signal;

generating a second binaural signal by attenuating, among components of a signal obtained by superimposing a second head-related transfer function between the virtual sound source and a second ear on a near side to the virtual sound source at the listening position on the acoustic signal, components of a first band and a second band, the first band and the second band being a lowest band and a second lowest hand, respectively, among bands in which a negative peak having a depth equal to or deeper than a predetermined depth appears on an amplitude of the first head-related transfer function at a frequency equal to or higher than a predetermined frequency; and performing a crosstalk compensation processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

5. A program for causing a computer to execute:

generating a first binaural signal by superimposing a first head-related transfer function between a virtual sound source deviated from a front center plane at a predetermined listening position to a left side or a right side and a first ear on a far side from the virtual sound source at the listening position on an acoustic signal;

generating a second binaural signal by attenuating, among components of a signal obtained by superimposing a second head-related transfer function between the virtual sound source and a second ear on a near side to the virtual sound source at the listening position on the acoustic signal, components of a first band and a second band, the first band and the second band being a lowest band and a second lowest band, respectively, among bands in which a negative peak having a depth equal to or deeper than a predetermined depth appears on an amplitude of the first head-related transfer function at a frequency equal to or higher than a predetermined frequency; and performing a crosstalk compensation processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

6. A computer-readable recording medium that stores therein a program according to claim 5.

7. An acoustic signal processing apparatus, comprising:

an attenuation unit configured to generate a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency; and a signal processing unit configured to perform, in an integrated manner, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal, and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

8. The acoustic signal processing apparatus according to claim 7, wherein the predetermined frequency is a frequency at which a positive peak appears in proximity of 4 kHz of the first head-related transfer function.

9. The acoustic signal processing apparatus according to claim 8, wherein the attenuation unit includes an infinite impulse response (IIR) filter, and the signal processing unit includes a finite impulse response (FIR) filter.

10. An acoustic signal processing method, comprising:

generating a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency; and performing, in an integrated manner, a processing for generating a first binaural signal by superimposing the first head-related transfer function on the second, acoustic signal and a second binaural signal by superimposing a second head-related transfer function between the virtual sound source and a second ear on a near side to the virtual sound source at the listening position on the second acoustic signal, and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

11. A program for causing a computer to execute:

generating a second acoustic signal by attenuating components of a first band and a second band among components of a first acoustic signal, the first band and the second band being a lowest band and a second lowest band, respectively, among bands in which a negative peak having a depth equal to or deeper than a predetermined depth appears on an amplitude of a first head-related transfer function between a virtual sound source deviated from a front center plane at a predetermined listening position to a left side or a right side and a first ear on a far side from the virtual sound source at the listening position at a frequency equal to or higher than a predetermined frequency; and performing, in an integrated manner, a processing for generating a first binaural signal by superimposing the first head-related transfer function on the second acoustic signal and a second binaural signal by superimposing a second head-related transfer function between the virtual sound source and a second ear on a near side to the virtual sound source at the listening position on the second acoustic signal, and a processing for canceling out, with respect to the first binaural signal and the second binaural signal, an acoustic transfer characteristic between a first speaker on a near side to the first ear between speakers arranged symmetrically with respect to the listening position and the first ear, an acoustic transfer characteristic between a second speaker on a near side to the second ear between the speakers arranged symmetrically with respect to the listening position and the second ear, a crosstalk from the first speaker to the second ear, and a crosstalk from the second speaker to the first ear.

12. A computer-readable recording medium that stores therein a program according to claim 11.

* * * * *